US010584670B2

(12) United States Patent
Noguchi

(10) Patent No.: US 10,584,670 B2
(45) Date of Patent: Mar. 10, 2020

(54) NOZZLE PLATE FOR FUEL INJECTION UNIT

(71) Applicant: ENPLAS CORPORATION, Saitama (JP)

(72) Inventor: Koji Noguchi, Saitama (JP)

(73) Assignee: Enplas Corporation, Saitama (JP)

( * ) Notice: Subject to any disclaimer, the term of this patent is extended or adjusted under 35 U.S.C. 154(b) by 163 days.

(21) Appl. No.: 15/513,026

(22) PCT Filed: Jul. 16, 2015

(86) PCT No.: PCT/JP2015/070366
§ 371 (c)(1),
(2) Date: Mar. 21, 2017

(87) PCT Pub. No.: WO2016/047252
PCT Pub. Date: Mar. 31, 2016

(65) Prior Publication Data
US 2017/0292489 A1 Oct. 12, 2017

(30) Foreign Application Priority Data
Sep. 22, 2014 (JP) ..... 2014-192344

(51) Int. Cl.
*F02M 61/18* (2006.01)
*F02M 51/06* (2006.01)
(Continued)

(52) U.S. Cl.
CPC ..... *F02M 61/1806* (2013.01); *B05B 1/3426* (2013.01); *B05B 1/3463* (2013.01);
(Continued)

(58) Field of Classification Search
CPC .... F02M 61/162; F02M 61/163; F02M 61/08; F02M 61/047; F02M 61/1853;
(Continued)

(56) References Cited

U.S. PATENT DOCUMENTS 5,570,841 A * 11/1996 Pace ..... F02M 51/061 239/496
2013/0255640 A1 10/2013 Okamoto et al.

FOREIGN PATENT DOCUMENTS

JP 10-507240 7/1998
JP 2002-364496 12/2002
(Continued)

OTHER PUBLICATIONS

International Search Report dated Sep. 8, 2015 in International (PCT) Application No. PCT/JP2015/070366.

*Primary Examiner* — Arthur O. Hall
*Assistant Examiner* — Tuongminh N Pham
(74) *Attorney, Agent, or Firm* — Wenderoth, Lind & Ponack, L.L.P.

(57) ABSTRACT

A nozzle hole of a nozzle plate is connected to a fuel injection nozzle of a fuel injection unit through a swirl chamber and first and second fuel guide grooves opened to the swirl chamber. The swirl chamber is an oval recess provided with the nozzle orifice in its center. A first fuel guide groove is opened to one end side of a major axis of the oval recess, and a second fuel guide groove is opened to the other end side of the major axis of the oval recess. The first and second fuel guide grooves are formed such that the same amount of fuel flows to the swirl chamber. The same amount of fuel flowing from the first and second fuel guide grooves to the swirl chamber is guided to the nozzle orifice at the same time while revolving inside the swirl chamber in the same direction.

7 Claims, 17 Drawing Sheets

(51) Int. Cl.

| | |
|---|---|
| ***F02M 61/16*** | (2006.01) |
| ***B05B 1/34*** | (2006.01) |
| ***F02M 61/08*** | (2006.01) |
| *F02M 61/04* | (2006.01) |

(52) U.S. Cl.
CPC ..... *F02M 51/06* (2013.01); *F02M 61/08* (2013.01); *F02M 61/163* (2013.01); *F02M 61/18* (2013.01); *F02M 61/1846* (2013.01); *F02M 61/1853* (2013.01); *F02M 61/047* (2013.01)

(58) Field of Classification Search
CPC ..... F02M 61/1806; F02M 61/1846; F02M 61/18; F02M 51/06; B05B 1/3426; B05B 1/3463; B05B 1/3421
See application file for complete search history.

(56) References Cited

FOREIGN PATENT DOCUMENTS

| | | |
|---|---|---|
| JP | 2013-209888 | 10/2013 |
| JP | 2013-249826 | 12/2013 |

* cited by examiner

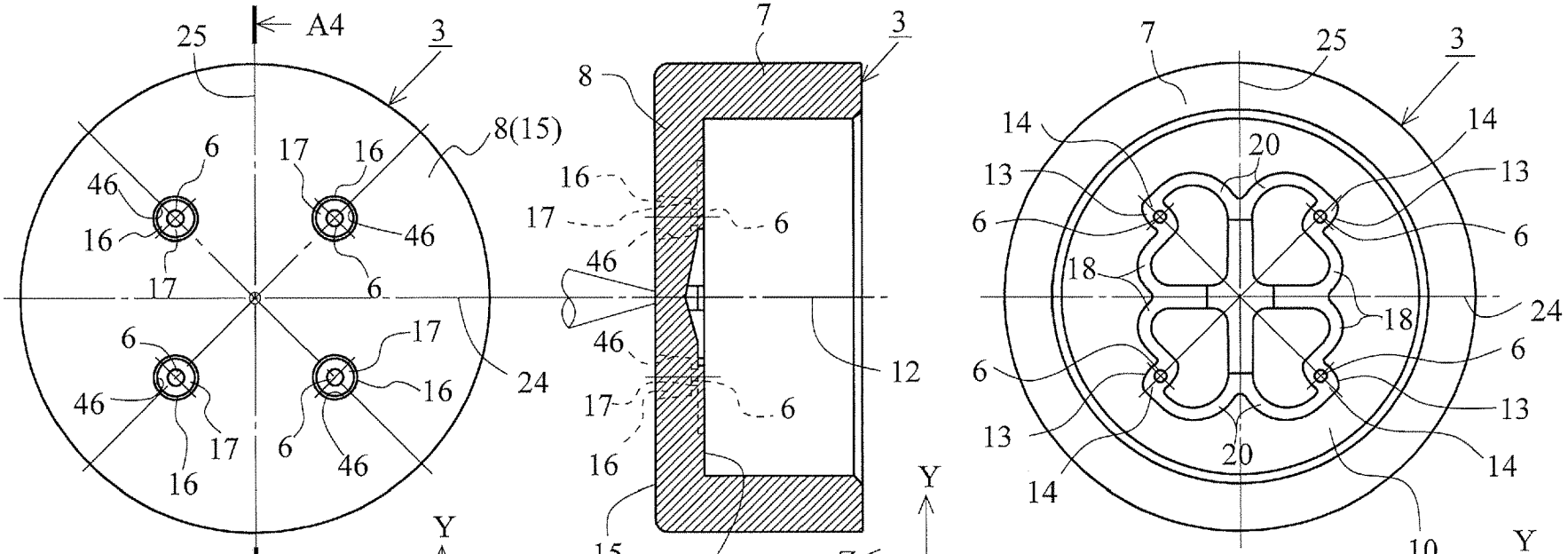
Fig. 8A
Fig. 8B
Fig. 8C
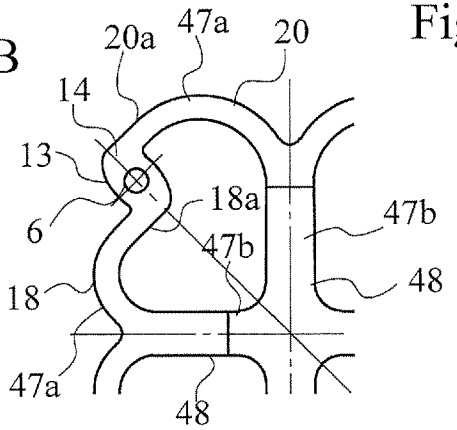
Fig. 8D

NOZZLE PLATE FOR FUEL INJECTION UNIT

TECHNICAL FIELD

The present invention relates to a nozzle plate for a fuel injection unit (hereinafter, simply referred to as a "nozzle plate") installed in a fuel injection nozzle of a fuel injection unit to atomize and inject fuel flowing from the fuel injection nozzle.

BACKGROUND ART

In an internal combustion engine (hereinafter, simply referred to as an "engine") of a vehicle or the like, a combustible gas mixture is prepared by mixing fuel injected from a fuel injection unit and the air introduced through an intake pipe and is combusted inside a cylinder. In such an engine, it is known that a mixing state between the air and the fuel injected from the fuel injection unit significantly affects engine performance. In particular, atomization of the fuel injected from the fuel injection unit is an important factor for engine performance.

In this fuel injection unit, a nozzle plate is installed in a fuel injection nozzle of a valve body in order to promote atomization of the sprayed fuel, so that the fuel is injected from a plurality of small nozzle orifices provided on this nozzle plate.

FIGS. 15A and 15B illustrate a nozzle plate 100 of the background art. The nozzle plate 100 of FIGS. 15A and 15B has a stack structure obtained by stacking the first and second nozzle plates 101 and 102. As illustrated in FIGS. 15A, 15B, 16A, and 16B, the first nozzle plate 101 is provided with a pair of first nozzle orifices 103A and 103B that penetrate through front and rear surfaces and are arranged in axial symmetrical positions with respect to a center line 105 extending along the X-axis on the center line 104 extending along the Y-axis. In addition, as illustrated in FIGS. 15A, 15B, 17A, and 17B, the second nozzle plate 102 is provided with a pair of second nozzle orifices 106A and 106B arranged in axial symmetrical positions with respect to the center line 104 extending along the Y-axis on the center line 105 extending along the X-axis direction. A pair of second nozzle orifices 106A and 106B communicate with the first nozzle orifices 103A and 103B through a pair of curved grooves 108A and 108B (first and second curved grooves 108A and 108B) formed in a face (surface) 107 side of the first nozzle plate 101 where the fuel impinges. In addition, the second nozzle plate 102 communicates with a pair of curved grooves 108A and 108B through a communication groove 110 extending along the center line 104.

In the nozzle plate 100 of the background art illustrated in FIGS. 15A and 15B, the fuel injected from the fuel injection nozzle of the valve body is introduced into the curved grooves 108A and 108B from the first nozzle orifices 103A and 103B, and the fuel flowing into the curved grooves 108A and 108B flows out from the second nozzle orifices 106A and 106B while making a rotary motion by virtue of the curved grooves 108A and 108B. As a result, improvement of fuel atomization quality is promoted (see Japanese Unexamined Patent Publication No. H10-507240).

However, as illustrated in FIGS. 15A and 15B, in the nozzle plate 100 of the background art, the first and second curved grooves 108A and 108B used to allow the first nozzle orifices 103A and 103B and the second nozzle orifices 106A (106B) to communicate with each other have different lengths. Therefore, a flow rate of the fuel flowing from the first nozzle orifice 103A to the second nozzle orifice 106A (106B) through the first curved groove 108A becomes different from a flow rate of the fuel flowing from the first nozzle orifice 103B to the second nozzle orifice 106A (106B) through the second curved groove 108B. This disadvantageously causes a variation in the spray (a variation in fuel particle size and a variation in concentration of the fuel particle in the spray) generated by injecting fuel from the second nozzle orifice 106A (106B).

In view of the aforementioned problems, it is therefore an object of the present invention to provide a nozzle plate capable of uniformly spraying fuel.

SUMMARY OF THE INVENTION

The present invention provides a nozzle plate 3 for a fuel injection unit provided with a plurality of nozzle orifices 6 placed to face a fuel injection nozzle 5 of a fuel injection unit 1 to allow passage of fuel injected from the fuel injection nozzle 5. In this invention, the nozzle orifice 6 is connected to the fuel injection nozzle 5 through a swirl chamber 13 and a first fuel guide groove 18 and a second fuel guide groove 20 opened to the swirl chamber 13. In addition, the swirl chamber 13 is an oval recess formed in a surface side facing the fuel injection nozzle 5 and provided with the nozzle orifice 6 in its center. The first fuel guide groove 18 is opened to one end side of a major axis 22 of the oval recess, and the second fuel guide groove 20 is opened to the other end side of the major axis 22 of the oval recess. The first and second fuel guide grooves 18 and 20 are formed such that the identical amount of fuel flows from the fuel injection nozzle 5 to the swirl chamber 13. Furthermore, a swirl chamber side connecting portion 18*a* of the first fuel guide groove 18 and a swirl chamber side connecting portion 20*a* of the second fuel guide groove 20 are formed to be double-symmetrical with respect to a center of the swirl chamber 13. Moreover, in the nozzle plate 3 for the fuel injection unit according to the present invention, an identical amount of the fuel flowing from the first and second fuel guide grooves 18 and 20 to the swirl chamber 13 is guided to the nozzle orifice 6 while revolving inside the swirl chamber 13 in an identical direction.

The present invention provides a nozzle plate 3 for a fuel injection unit provided with a plurality of nozzle orifices 6 placed to face a fuel injection nozzle 5 of a fuel injection unit 1 to allow passage of fuel injected from the fuel injection nozzle 5. In this invention the nozzle orifice 6 is connected to the fuel injection nozzle 5 through a swirl chamber 13, a first fuel guide groove 18, and a second fuel guide groove 20 opened to the swirl chamber 13. The swirl chamber 13 is shaped by bisecting an oval recess into a first semi-oval recess 43 and a second semi-oval recess 44 with respect to a major axis 22 of the oval recess and deviating the first semi-oval recess 43 and the second semi-oval recess 44 from each other along the major axis 22 as a surface side facing the fuel injection nozzle 5 is seen in a plan view. The first fuel guide groove 18 is opened to the first semi-oval recess 43 positioned in one end side of the major axis 22 and a deviated part of the second semi-oval recess 44, and the second fuel guide groove 20 is opened to the first semi-oval recess 43 positioned in the other end side of the major axis 22 and a deviated part of the second semi-oval recess 44. In addition, the first and second fuel guide grooves 18 and 20 are formed such that the identical amount of fuel flows from the fuel injection nozzle 5 to the swirl chamber 13. Furthermore, a swirl chamber side connecting portion 18*a* of the first fuel guide groove 18 and a swirl chamber side connecting portion 20*a* of the second fuel guide groove 20 are formed to be double-symmetrical with respect to a center of the swirl chamber 13. Moreover, in the nozzle plate 3 for the fuel injection unit according to the present invention, an identical amount of the fuel flowing from the first and second fuel guide grooves 18 and 20 to the swirl chamber 13 is guided to the nozzle orifice 6 while revolving inside the swirl chamber 13 in an identical direction.

The present invention provides a nozzle plate 3 for a fuel injection unit provided with a plurality of nozzle orifices 6 placed to face a fuel injection nozzle 5 of a fuel injection unit 1 to allow passage of fuel injected from the fuel injection nozzle 5. In this invention, the nozzle orifice 6 is connected to the fuel injection nozzle 5 through a swirl chamber 13, a first fuel guide groove 18, and a second fuel guide groove 20 opened to the swirl chamber 13. The swirl chamber 13 is an oval recess formed in a surface side facing the fuel injection nozzle 5 and provided with the nozzle orifice 6 in its center 60. The first fuel guide groove 18 is opened to one end side of a minor axis 63 of the oval recess, and the second fuel guide groove 20 is opened to the other end side of the minor axis 63 of the oval recess. In addition, the first and second fuel guide grooves 18 and 20 are formed such that the identical amount of fuel flows from the fuel injection nozzle 5 to the swirl chamber 13. Furthermore, a swirl chamber side connecting portion 65*a* of the first fuel guide groove 18 and a swirl chamber side connecting portion 65*a* of the second fuel guide groove 20 are formed to be double-symmetrical with respect to the center 60 of the swirl chamber 13. Moreover, an identical amount of the fuel flowing from the first and second fuel guide grooves 18 and 20 to the swirl chamber 13 is guided to the nozzle orifice 6 while revolving inside the swirl chamber 13 in an identical direction.

The present invention provides a nozzle plate 3 for a fuel injection unit provided with a plurality of nozzle orifices 6 placed to face a fuel injection nozzle 5 of a fuel injection unit 1 to allow passage of fuel injected from the fuel injection nozzle 5. In this invention, the nozzle orifice 6 is connected to the fuel injection nozzle 5 through a swirl chamber 13, a first fuel guide groove 18, and a second fuel guide groove 20 opened to the swirl chamber 13. The swirl chamber 13 is shaped by combining a first oval recess 61 formed in a surface side facing the fuel injection nozzle 5 and a second oval recess 62 having an identical size as that of the first oval recess 61. The second oval recess 62 has a minor axis 63 arranged in an extension line of a minor axis 63 of the first oval recess 61, and the second oval recess 62 has a center 62*a* separated from a center 61*a* of the first oval recess 61 by a predetermined length (ε). The first and second oval recesses 61 and 62 partially overlap with each other. The first fuel guide groove 18 is opened to an end side of the minor axis 63 of the first oval recess 61 not overlapping with the second oval recess 62 in an end side of the minor axis 63 of the first oval recess 61, and the second fuel guide groove 20 is opened to an end side of the minor axis 63 of the second oval recess 62 not overlapping with the first oval recess 61 in an end side of the minor axis 63 of the second oval recess 62. The nozzle orifice 6 is formed in a center 60. In addition, the first and second fuel guide grooves 18 and 20 are formed such that the identical amount of fuel flows from the fuel injection nozzle 5 to the swirl chamber 13. Furthermore, a swirl chamber side connecting portion 65*a* of the first fuel guide groove 18 and a swirl chamber side connecting portion 65*a* of the second fuel guide groove 20 are formed to be double-symmetrical with respect to a center 60 of the swirl chamber 13. Moreover, an identical amount of the fuel flowing from the first and second fuel guide grooves 18 and 20 to the swirl chamber 13 is guided to the nozzle orifice 6 while revolving inside the swirl chamber 13 in an identical direction.

According to the present invention, the identical amount of fuel flows to the swirl chamber from the swirl chamber side connecting portions of the first and second fuel guide grooves formed to be double-symmetrical with respect to the swirl chamber, and the identical amount of fuel flowing to the swirl chamber is guided to the nozzle orifice while revolving inside the swirl chamber in the identical direction. Therefore, it is possible to suppress a variation in the spray generated by injecting fuel from the nozzle orifice and achieve uniform fuel spray.

BRIEF DESCRIPTION OF DRAWINGS

FIGS. 2A to 2D are diagrams illustrating a nozzle plate according to the first embodiment of the invention, in which FIG. 2A is a front view illustrating the nozzle plate, FIG. 2B is a cross-sectional view taken along a line A1-A1 of FIG. 2A to illustrate the nozzle plate, FIG. 2C is a rear view illustrating the nozzle plate, and FIG. 2D is a partial enlarged view of FIG. 2C;

FIGS. 5A to 5C are diagrams illustrating a nozzle plate according to a first modification of the first embodiment of the invention, in which FIG. 5A is a front view illustrating the nozzle plate, FIG. 5B is a cross-sectional view taken along a line A2-A2 of FIG. 5A to illustrate the nozzle plate, and FIG. 5C is a rear view illustrating the nozzle plate;

FIGS. 7A to 7C are diagrams illustrating a nozzle plate according to a second modification of the first embodiment of the invention, in which FIG. 7A is a front view illustrating the nozzle plate, FIG. 7B is a cross-sectional view taken along a line A3-A3 of FIG. 7A to illustrate the nozzle plate, and FIG. 7C is a rear view illustrating the nozzle plate;

FIGS. 8A to 8D are diagrams illustrating a nozzle plate according to a second embodiment of the invention, in which FIG. 8A is a front view illustrating a nozzle plate, FIG. 8B is a cross-sectional view taken along a line A4-A4 of FIG. 8A to illustrate the nozzle plate, FIG. 8C is a rear view illustrating the nozzle plate, and FIG. 8D is a partial enlarged view of FIG. 8C;

FIGS. 9A to 9C are diagrams illustrating a nozzle plate according to a modification of the second embodiment of the invention, in which FIG. 9A is a front view illustrating the nozzle plate, FIG. 9B is a cross-sectional view taken along a line A5-A5 of FIG. 9A to illustrate the nozzle plate, and FIG. 9C is a rear view illustrating the nozzle plate;

FIGS. 10A to 10D are diagrams illustrating a nozzle plate according to a third embodiment of the invention, in which FIG. 10A is a front view illustrating the nozzle plate, FIG. 10B is a cross-sectional view taken along a line A6-A6 of FIG. 10A to illustrate the nozzle plate, FIG. 10C is a rear view illustrating the nozzle plate, and FIG. 10D is a partial enlarged view of FIG. 10C;

FIGS. 11A to 11C are diagrams illustrating a nozzle plate according to a fourth embodiment of the invention, in which FIG. 11A is a front view illustrating the nozzle plate, FIG. 11B is a cross-sectional view taken along a line A7-A7 of FIG. 11A to illustrate the nozzle plate, and FIG. 11C is a rear view illustrating the nozzle plate;

FIGS. 13A and 13B are diagrams illustrating a nozzle plate according to a first modification of the fourth embodiment of the invention, in which FIG. 13A is a rear view illustrating the nozzle plate, and FIG. 13B is a partial enlarged view of FIG. 13A;

FIGS. 14A and 14B are diagrams illustrating a nozzle plate according to a second modification of the fourth embodiment of the invention, in which FIG. 14A is a rear view illustrating the nozzle plate, and FIG. 14B is a partial enlarged view of FIG. 14A;

FIGS. 15A and 15B are diagrams illustrating a nozzle plate of the prior art, in which FIG. 15A is a front view illustrating the nozzle plate, and FIG. 15B is a cross-sectional view taken along a line A8-A8 of FIG. 15A to illustrate the nozzle plate;

FIGS. 16A and 16B are diagrams illustrating a first nozzle plate of the nozzle plate of the prior art, in which FIG. 16A is a front view illustrating the first nozzle plate, and FIG. 16B is a cross-sectional view taken along a line A9-A9 of FIG. 16A to illustrate the first nozzle plate; and FIGS. 17A and 17B are diagrams illustrating a second nozzle plate of the nozzle plate of the prior art, in which FIG. 17A is a front view illustrating the second nozzle plate, and FIG. 17B is a cross-sectional view taken along a line A10-A10 of FIG. 17A to illustrate the second nozzle plate.

DESCRIPTION OF EMBODIMENTS

Embodiments of the present invention will now be described with reference to the accompanying drawings.

<First Embodiment>

Figure 1:
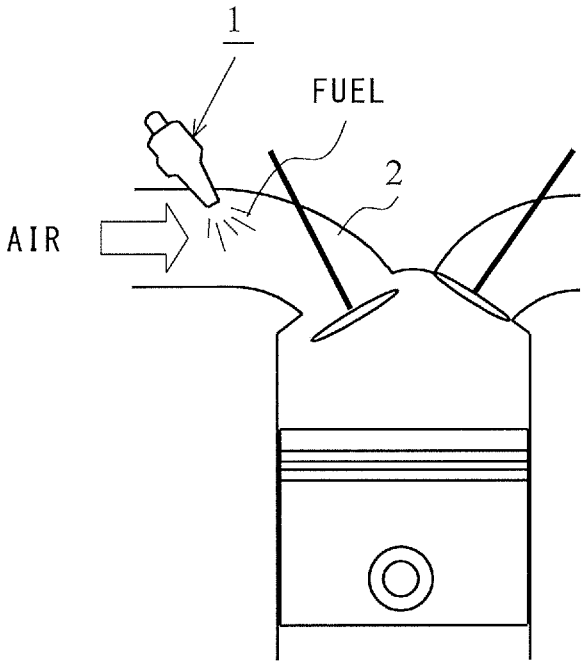
FIG. 1 is a diagram schematically illustrating a use state of a fuel injection unit installed with a nozzle plate for a fuel injection unit according to a first embodiment of the invention.

FIG. 1 is a diagram schematically illustrating a use state of a fuel injection unit 1 installed with a nozzle plate according to a first embodiment of the present invention. As illustrated in FIG. 1, a port-injection type fuel injection unit 1 is installed in the middle of an intake pipe 2 of an engine to spay fuel into the intake pipe 2. The sprayed fuel is mixed with the air introduced to the intake pipe 2 to generate a combustible gas mixture.

Figure 2C:
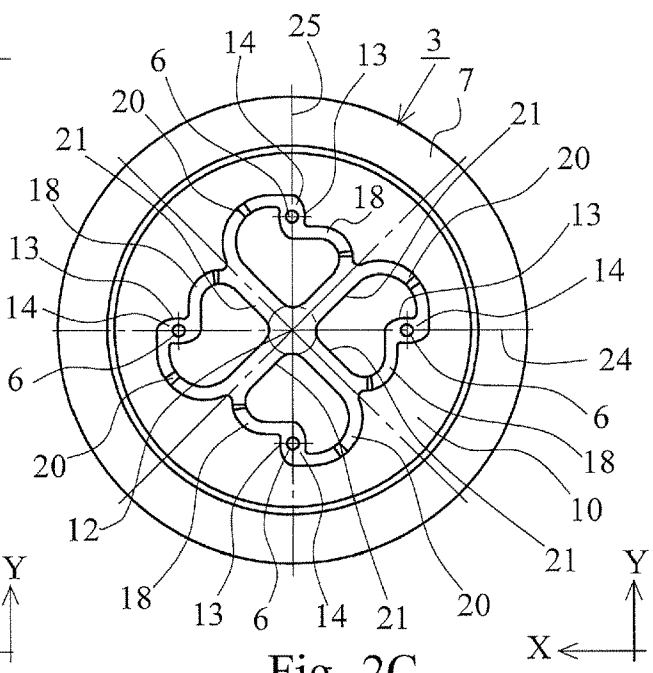
Figure 2B:
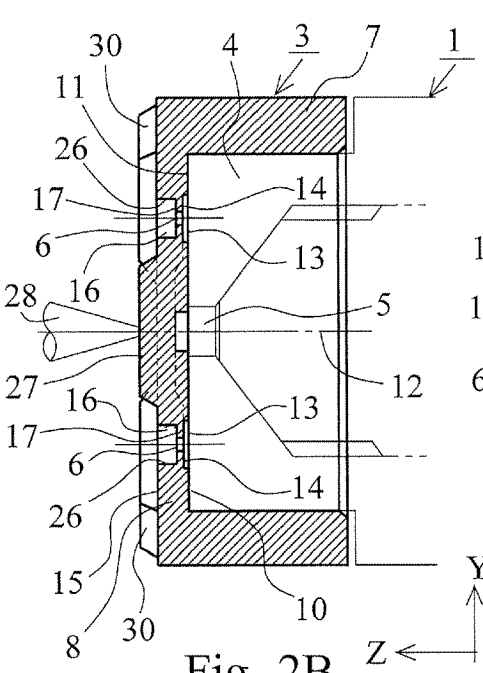
Figure 2A:
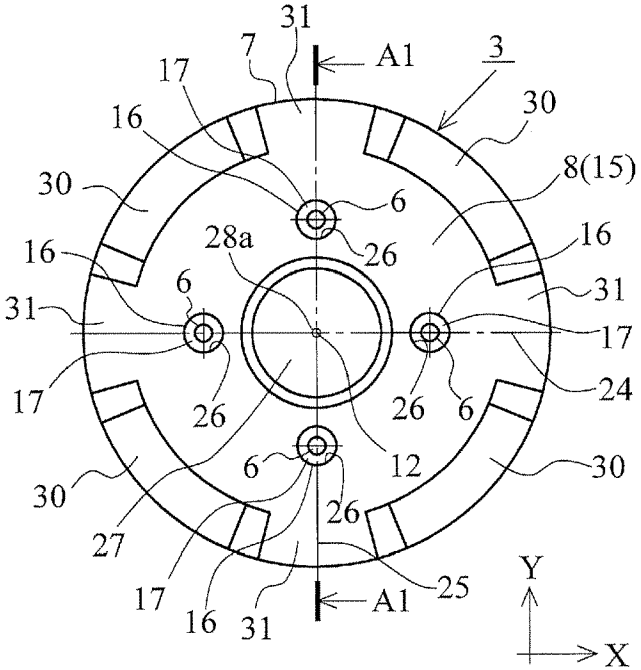
Figure 2D:
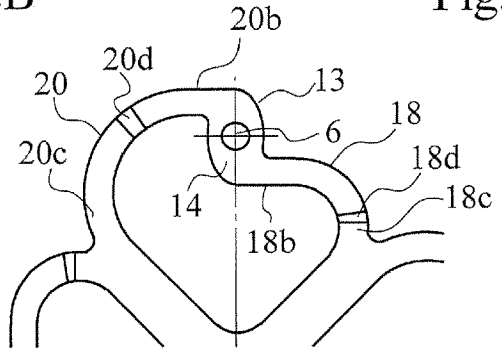

FIGS. 2A to 2D are diagrams illustrating a nozzle plate 3 according to a first embodiment of the invention. Note that FIG. 2A is a front view illustrating the nozzle plate 3, FIG. 2B is a cross-sectional view taken along a line A1-A1 of FIG. 2A to illustrate the nozzle plate 3, FIG. 2C is a rear view illustrating the nozzle plate 3, and FIG. 2D is a partial enlarged view illustrating the nozzle plate of FIG. 2C.

As illustrated in FIGS. 2A to 2D, the nozzle plate 3 is installed in a tip of a valve body 4 of the fuel injection unit 1 to spray the fuel injected from the fuel injection nozzle 5 of the valve body 4 from a plurality of nozzle orifices 6 (four nozzle orifices in this embodiment) to an intake pipe 2 side. The nozzle plate 3 is a bottomed cylindrical body formed of a synthetic resin material (such as PPS, PEEK, POM, PA, PES, PEI, LCP) including a cylindrical fitting portion 7 and a plate body portion 8 integrated into one end side of the cylindrical fitting portion 7. In addition, the nozzle plate 3 is fixed to the valve body 4 by fitting the cylindrical fitting portion 7 into a tip-side outer circumference of the valve body 4 without any gap while an inner surface 10 of the plate body portion 8 abuts on a leading end surface 11 of the valve body 4.

The plate body portion 8 is formed in a circular disk shape and is provided with a plurality of (four) nozzle orifices 6 at equal intervals around a center axis 12. This nozzle orifice 6 has one end opened to a bottom surface 14 of a swirl chamber 13 formed on a surface 10 (inner surface) side facing the fuel injection nozzle 5 of the plate body portion 8 and the other end opened to a bottom surface 17 of a bottomed recess 16 serving as a spray guide formed in an outer surface 15 side of the plate body portion 8 (the surface opposite to the inner surface 10). In addition, the nozzle orifice 6 is centered in the bottom surface 14 of the swirl chamber 13 and is centered in the bottom surface 17 of the recess 16. Furthermore, the nozzle orifice 6 is connected to the fuel injection nozzle 5 of the valve body 4 through the swirl chamber 13, the first and second fuel guide grooves 18 and 20, and the common fuel guide groove 21. For this reason, the fuel injected from the fuel injection nozzle 5 is guided to the nozzle orifice 6 through the common fuel guide groove 21, the first and second fuel guide grooves 18 and 20, and the swirl chamber 13.

Figure 3A:
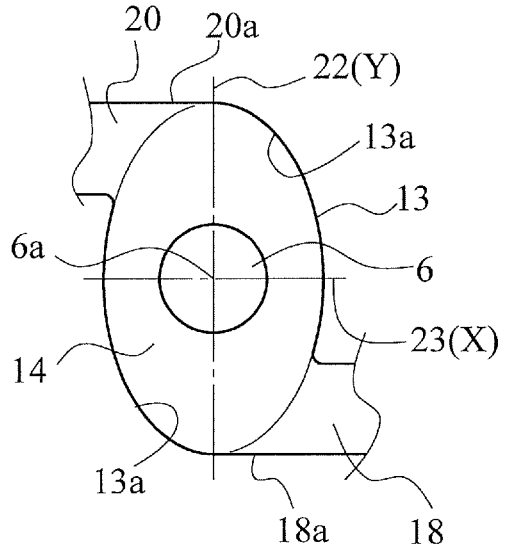
FIG. 3A is a detailed view illustrating a swirl chamber of the nozzle plate according to the first embodiment of the invention.

As specifically illustrated in FIG. 3A, the swirl chamber 13 is an oval recess hollowed at a predetermined depth from the inner surface 10 (oval recess as seen in a plan view) and is provided with a nozzle orifice 6 in its center. A first fuel guide groove 18 is opened in a first end side of the swirl chamber 13 along a major axis 22 passing through the center of the nozzle orifice 6, and a second fuel guide groove 20 is opened in the other (second) end side of the swirl chamber 13 along the major axis 22. In addition, assuming that the major axis 22 corresponds to a Y-axis of a X-Y coordinate plane, and a center line (minor axis) 23 passing through the center 6*a* of the nozzle orifice 6 perpendicularly to the major axis 22 corresponds to an X-axis of the X-Y coordinate plane, the space of the swirl chamber 13 around the nozzle orifice 6 is narrowed toward the X-axis in a right turn direction (fuel flow direction) from the Y-axis.

A pair of the swirl chamber 13 and the nozzle orifice 6 are provided on the center line 24 passing through the center of the plate body portion 8 in parallel to the X-axis, and another pair of the swirl chamber 13 and the nozzle orifice 6 are provided on the center line 25 passing through the center of the plate body portion 8 in parallel to the Y-axis (see FIG. 2C). The centers 6*a* of each pair of the swirl chamber 13 and the respective nozzle orifice 6 are placed at intervals of 90° apart on a virtual circle coaxial with the center 12 of the plate body portion 8. With respect to the swirl chambers 13 and the nozzle orifices 6, the common fuel guide grooves 21 extends radially outward from the center 12 of the nozzle plate body portion 8 between the perpendicular center lines 24 and 25. Note that an intersection of the four common fuel guide grooves 21 serves as a fuel pocket that temporarily stores the fuel injected from the fuel injection nozzle 5.

A swirl chamber side connecting portion 18*a* of the first fuel guide groove 18 and a swirl chamber side connecting portion 20*a* of the second fuel guide groove 20 are formed to be double-symmetrical with respect to the center 6*a* of the swirl chamber 13 and are opened to the swirl chamber 13 perpendicularly to the major axis 22 (i.e., the connecting portions 18*a*, 20*a* are symmetrical about the center 6*a* of the swirl chamber such that the swirl chamber and connecting portions 18*a*, 20*a* will have the same shape if rotated 180°). In addition, one of the side walls of the swirl chamber side connecting portions 18*a* and 20*a* extends in a tangential direction from a position on the major axis 22 of the inner wall surface 13*a* of the swirl chamber 13 and is smoothly connected to the inner wall surface 13*a* of the swirl chamber 13.

The first fuel guide groove 18 is branched from one of the neighboring common fuel guide grooves 21. In addition, the second fuel guide groove 20 is branched from the other one of the neighboring common fuel guide grooves 21. In addition, the first and second fuel guide grooves 18 and 20 include first fuel guide groove portions 18*b* and 20*b* connected to the swirl chamber 13 with the identical depth as that of the swirl chamber 13, second fuel guide groove portions 18*c* and 20*c* formed to have a depth deeper than those of the first fuel guide groove portions 18*b* and 20*b* to guide fuel from the common fuel guide groove 21 to the first fuel guide groove portions 18*b* and 20*b*, and connecting groove portions 18*d* and 20*d* that connect the second fuel guide groove portions 18*c* and 20*c* and the first fuel guide groove portions 18*b* and 20*b* by gradually reducing the depth. Note that the four common fuel guide grooves 21 have the identical length.

The first and second fuel guide grooves 18 and 20 have the identical width and different lengths from the common fuel guide groove 21 to the swirl chamber 13. For this reason, in the first and second fuel guide grooves 18 and 20, the lengths of the first fuel guide groove portions 18*b* and 20*b* and the lengths of the second fuel guide groove portions 18*c* and 20*c* are designed such that the identical amount of fuel is guided from the common fuel guide groove 21 to the swirl chamber 13. That is, if the length of the second fuel guide groove 20 is longer than the first fuel guide groove 18, the length of the first fuel guide groove portion 20*b* of the second fuel guide groove 20 is set to be shorter than the length of the first fuel guide groove portion 18*b* of the first fuel guide groove 18, and the length of the second fuel guide groove portion 20*c* of the second fuel guide groove 20 is set to be longer than the second fuel guide groove portion 18*c* of the first fuel guide groove 18, so that the fuel can more easily flow to the second fuel guide groove 20 than the first fuel guide groove 18. As a result, the identical amount of fuel reaches the swirl chamber 13 by flowing through each of the first and second fuel guide grooves 18 and 20. In addition, the identical amount of fuel flowing from the swirl chamber side connecting portions 18*a* and 20*a* of the first and second fuel guide grooves 18 and 20 to the swirl chamber 13 is guided to the nozzle orifice 6 at the identical time while revolving inside the swirl chamber 13 in the identical direction.

The bottomed recess 16 formed in the outer surface 15 side of the plate body portion 8 has a cylindrical inner surface 26 (spray guide) having a diameter slightly larger than that of the nozzle orifice 6, so that dispersion of the spray generated by injecting fuel from the nozzle orifice 6 is suppressed by the cylindrical inner surface 26, and a spray injection direction is controlled by the cylindrical inner surface 26. As a result, fuel particles contained in the spray flowing from the bottomed recess 16 are less attached on the inner wall surface of the intake pipe 2 or the like. Therefore, fuel use efficiency is improved.

A gate seat 27 having a truncated conical shape protrudes in a part of the outer surface 15 side of the plate body portion 8 surrounded by a plurality of nozzle orifices 6, and a separation trace 28*a* of the gate 28 for injection molding is formed in the center of the gate seat 27. Note that, in order to injection-molding the nozzle orifices 6 of the nozzle plate 3 and the surrounding part of the nozzle orifices 6 with high accuracy, the center of the gate seat 27 and the center of the separation trace 28*a* of the gate 28 are preferably arranged coaxially with the center of the plate body portion 8.

Reinforcing protrusions 30 are protrudingly formed between neighboring nozzle orifices 6 in the outer surface 15 side of the plate body portion 8 and in a radial outward end side of the plate body portion 8. In addition, ventilation trenches 31 are formed between the neighboring reinforcing protrusions 30 in the radial outward side of the nozzle orifice 6. The reinforcing protrusion 30 protrudes from the outer surface 15 of the plate body portion 8 at the identical height as that of the gate seat 27 to reinforce the plate body portion 8 along with the gate seat 27. In addition, the ventilation trenches 31 formed between the neighboring reinforcing protrusions 30 allow the spray injected through the nozzle orifices 6 and the bottomed recesses (spray guides) 16 to be effectively mixed with the air around the plate body portion 8.

Figure 4:
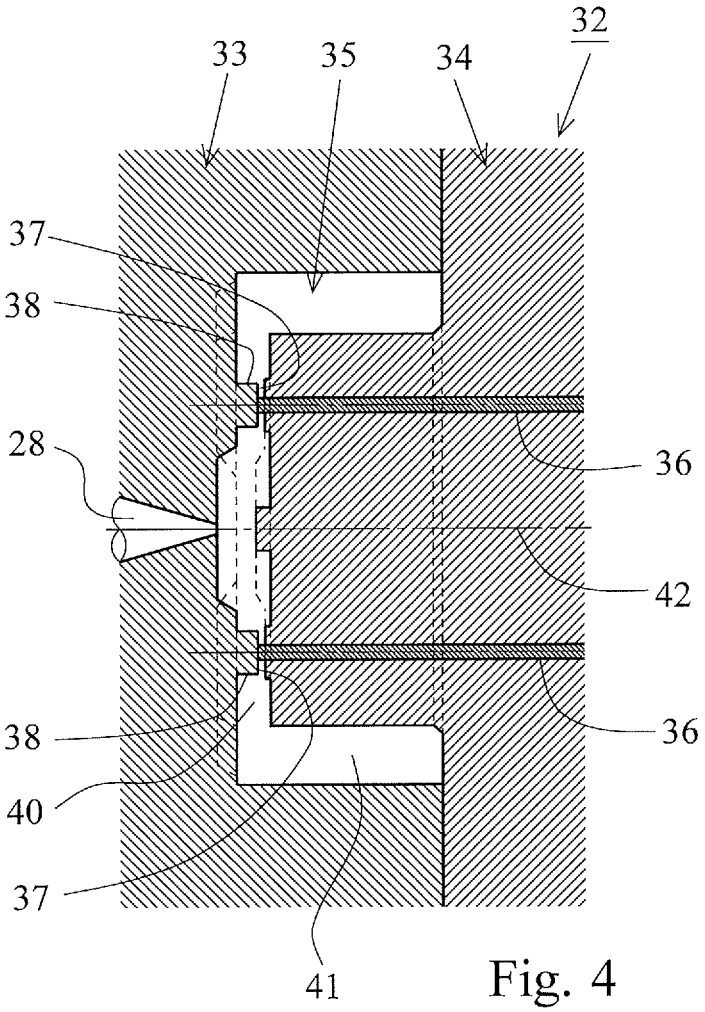
FIG. 4 is a cross-sectional view illustrating a mold for injection-molding the nozzle plate according to the first embodiment of the invention.

FIG. 4 is a diagram illustrating a mold structure for injection-molding the nozzle plate 3 according to this embodiment. The mold 32 of FIG. 4 includes first and second molds 33 and 34, a cavity 35 formed between first and second molds 33 and 34, and a nozzle orifice shaping pin 36 protruding into the cavity 35 to form the nozzle orifice 6. A tip of the nozzle orifice shaping pin 36 impinges on the cavity inner surface 37 of the first mold 33. The impinging portion between the first mold 33 and the nozzle orifice shaping pin 36 is a convex portion 38 for shaping the bottomed recess 16. The cavity 35 includes a first cavity portion 40 for shaping the plate body portion 8 and a second cavity portion 41 for shaping the cylindrical fitting portion 7. In addition, at the center of the first cavity portion 40, a gate 28 for injecting molten resin into the cavity 35 is opened. The center of the opening of the gate 28 is positioned on the center axis 42 of the cavity 35 at equal distances from the centers of a plurality of nozzle orifices 6 (at the center of the nozzle orifice shaping pin 36) (refer to FIGS. 2A and 2B).

In this mold 32, as molten resin is injected from the gate 28 to the cavity 35, the molten resin flows radially inside the cavity 35 and reaches the parts for shaping a plurality of nozzle orifices 6 in the first cavity portion 40 (the cavity portion that surrounds a plurality of nozzle orifice shaping pins 36) at the identical time. After the molten resin is filled in the cavity portion that surrounds a plurality of nozzle orifice shaping pins 36, the molten resin uniformly and radially flows to a radial outward end of the first cavity portion 40. Then, the molten resin is filled in the second cavity portion 41. In addition, in the mold 32 according to the first embodiment, the cavity portion for shaping the nozzle orifice 6 is positioned in the vicinity of the gate 28, so that an injection pressure and a follow-up pressure are uniformly and reliably applied to the cavity portion for shaping the nozzle orifice 6. Therefore, it is possible to shape the nozzle orifice 6 and its surrounding parts with high accuracy. In addition, by injection-molding the nozzle plate 3 using the mold 32 according to the first embodiment, it is possible to improve manufacturing efficiency of the nozzle plate 3 and reduce cost of the nozzle plate 3, compared to a case where the nozzle plate 3 is fabricated by cutting or machining. Note that the nozzle plate 3 subjected to the injection molding has a separation trace (gate trace) 28*a* of the gate 28 at the center of the gate seat 27 and at the center of the plate body portion 8 (at equal distances from the centers of each nozzle orifice 6).

In the nozzle plate 3 having the aforementioned configuration according to the first embodiment, the identical amount of fuel flowing from the swirl chamber side connecting portions 18*a* and 20*a* of the first and second fuel guide grooves 18 and 20 to the swirl chamber 13 is guided to the nozzle orifice 6 at the identical time while revolving inside the swirl chamber 13 in the identical direction. Therefore, a variation of the spray generated by injecting fuel from the nozzle orifice 6 (a variation in fuel particle size and a variation in concentration of the fuel particle in the spray) is suppressed. Therefore, it is possible to facilitate uniform atomized spray.

In the nozzle plate 3 according to the first embodiment, the fuel flowing into and revolving inside the swirl chamber 13 from the swirl chamber side connecting portion 18*a* of the first fuel guide groove 18 and the fuel flowing into and revolving inside the swirl chamber 13 from the swirl chamber side connecting portion 20*a* of the second fuel guide groove 20 react with each other to increase a rotary force of the fuel. In addition, in the nozzle plate 3 according to this embodiment, the fuel flowing from the swirl chamber side connecting portions 18*a* and 20*a* of the first and second fuel guide grooves 18 and 20 to the swirl chamber 13 flows to the nozzle orifice 6 along a downstream side of the flow direction, so that a flow rate of the fuel revolving and flowing inside the swirl chamber 13 is gradually reduced. However, since the space around the nozzle orifice 6 in the swirl chamber 13 is narrowed from the Y-axis to the X-axis (in the downstream side of the fuel flow direction), it is possible to suppress a velocity reduction of the fuel revolving and flowing inside the swirl chamber 13. As a result, using the nozzle plate 3 according to this embodiment, it is possible to promote atomization of the fuel particles in the spray generated by injecting fuel from the nozzle orifice 6.

In the nozzle plate 3 according to this embodiment, dispersion of the uniform atomized spray generated by injecting fuel from the nozzle orifice 6 is suppressed by the cylindrical inner surface 26 (spray guide) of the bottomed recess 16 formed in the outer surface 15 side of the plate body portion 8, and the spray injection direction is controlled by the cylindrical inner surface 26 of the bottomed recess 16. Therefore, the fuel particles are less attached on the inner wall surface of the intake pipe 2 and the like, and fuel use efficiency is improved.

<First Modification of Swirl Chamber>

Figure 3B:
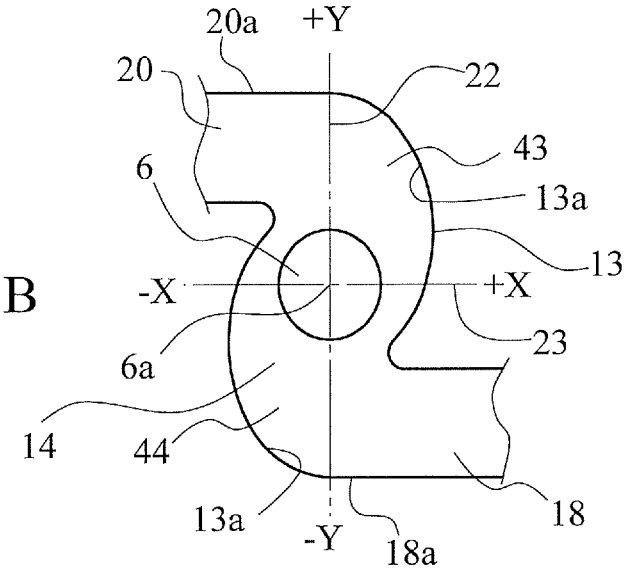
FIG. 3B is a detailed view illustrating a swirl chamber according to a first modification.

FIG. 3B is a diagram illustrating a first modification of the swirl chamber 13 for showing a shape of the swirl chamber 13 in a plan view.

As illustrated in FIG. 3B, the swirl chamber 13 according to this modification is bisected into first and second semi-oval-shaped recesses 43 and 44 offset from each other along the major axis 22 of the oval recess, and forms a surface (inner surface 10) of the plate body portion 8 which faces the fuel injection nozzle 5 as seen in a plan view. Meanwhile, the first and second semi-oval-shaped recesses 43 and 44 are deviated (offset) from each other along the major axis 22. The second fuel guide groove 20 is opened in a junction between the first semi-oval-shaped recess 43 located at a first end side of the swirl chamber 13 along the major axis 22 and the offset part of the second semi-oval recess 44. In addition, the first fuel guide groove 18 is opened in a junction between the first semi-oval-shaped recess 43 located in the other (second) end side of the swirl chamber 13 along the major axis 22 and the offset part of the second semi-oval-shaped recess 44. In addition, the swirl chamber side connecting portion 18*a* of the first fuel guide groove 18 and the swirl chamber side connecting portion 20*a* of the second fuel guide groove 20 are formed double-symmetrically (i.e., symmetrical with respect to the X-axis and Y-axis) with respect to the center 6*a* of the swirl chamber 13 and are opened to the swirl chamber 13 perpendicularly to the Y-axis. In addition, one of a pair of side walls extends in a tangential direction of the inner wall surface 13*a* of the swirl chamber 13.

A nozzle orifice 6 is formed in the center of the swirl chamber 13. In addition, assuming that the major axis 22 corresponds to the Y-axis on the X-Y coordinate plane, and the center line 23 passing through the center 6*a* of the nozzle orifice 6 perpendicularly to the major axis 22 corresponds to the X-axis on the X-Y coordinate plane, the space around the nozzle orifice 6 of the swirl chamber 13 is narrowed along the fuel flow direction (right turn direction) from the Y-axis to a part exceeding the X-axis. In this manner, a narrowing range of the space around the nozzle orifice 6 of the swirl chamber 13 according to this modification along the fuel flow direction is wider than that of the swirl chamber 13 of FIG. 3A. Therefore, using the swirl chamber 13 according to the first modification, it is possible to more effectively suppress a velocity reduction of the fuel revolving and flowing inside the swirl chamber 13, compared to the swirl chamber 13 of FIG. 3A.

<Second Modification of Swirl Chamber>

Figure 3C:
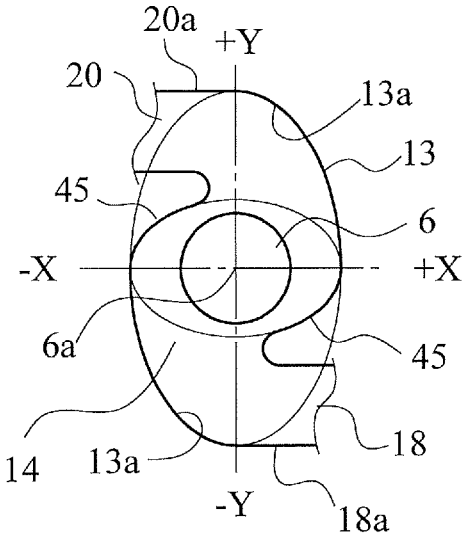
FIG. 3C is a detailed view illustrating a swirl chamber according to a second modification.

FIG. 3C is a diagram illustrating a swirl chamber 13 according to a second modification to show the swirl chamber 13 in a plan view.

As illustrated in FIG. 3C, in the swirl chamber 13 according to this modification, as a surface (inner surface 10) of the plate body portion 8 facing the fuel injection nozzle 5 is seen in a plan view, a part of the swirl chamber (oval recess) 13 of FIG. 3A is shaped in a part of a subsidiary oval recess 45 formed by setting the minor axis of the oval recess 13 as a major axis. That is, in FIG. 3C, assuming that the inner surface 10 of the plate body portion 8 corresponds to the X-Y coordinate plane, a minor axis of the oval recess 13 passing through the center 6*a* of the nozzle orifice 6 corresponds to the X-axis, and a major axis of the oval recess 13 passing through the center 6*a* of the nozzle orifice 6 corresponds to the Y-axis, first and third quadrants are shaped in the oval recess 13, and second and fourth quadrants are predominantly shaped in the subsidiary oval recess 45. In addition, the center 6*a* of the nozzle orifice 6 is placed in the center of the swirl chamber 13, that is, a cross point between the X-axis and the Y-axis. Furthermore, a second fuel guide groove 20 is opened in one end side of the Y-axis direction of the swirl chamber 13, and a first fuel guide groove 18 is opened in the other end side of the Y-axis direction of the swirl chamber 13. Moreover, the swirl chamber side connecting portion 18*a* of the first fuel guide groove 18 and the swirl chamber side connecting portion 20*a* of the second fuel guide groove 20 are formed double-symmetrically with respect to the center of the swirl chamber 13 and are opened to the swirl chamber 13 perpendicularly to the Y-axis. One of a pair of side walls extends in a tangential direction of the inner wall surface 13*a* of the swirl chamber 13.

In the swirl chamber 13 of FIG. 3C, the space around the nozzle orifice 6 is narrowed along the fuel flow direction (right turn direction) from the +Y-axis to the vicinity of the −Y-axis. In this manner, a range narrowed along the fuel flow direction in the space around the nozzle orifice 6 in the swirl chamber 13 according to this modification is wider than those of the swirl chambers 13 of FIGS. 3A and 3B. Therefore, using the swirl chamber 13 according to this modification, it is possible to more effectively suppress a velocity reduction of the fuel revolving and flowing inside the swirl chamber 13, compared to the swirl chambers 13 of FIGS. 3A and 3B.

<First Modification of Nozzle Plate>

Figure 5C:
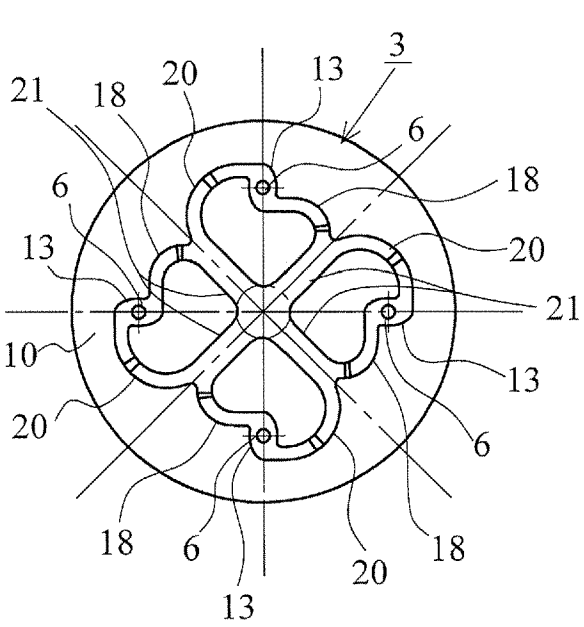
Figure 5B:
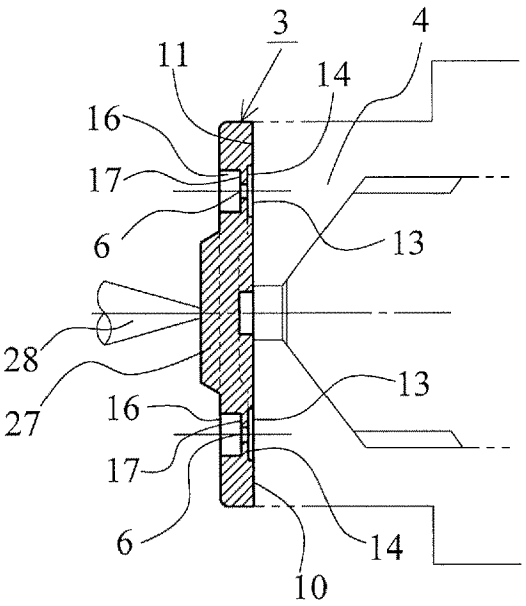
Figure 5A:
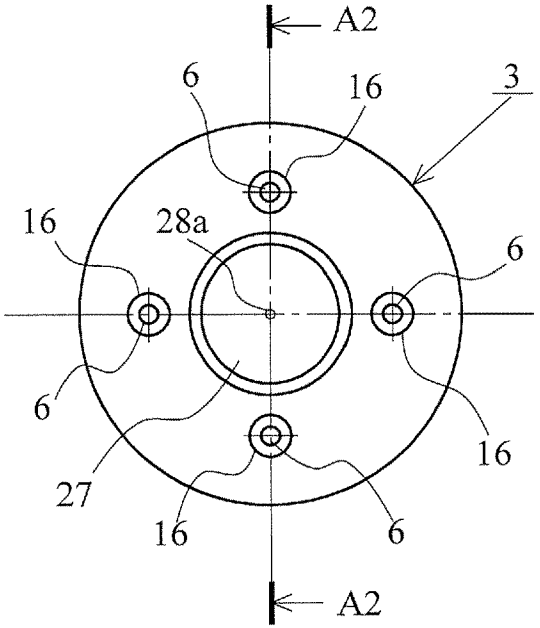

FIGS. 5A to 5C are diagrams illustrating a nozzle plate 3 according to this modification. Note that FIG. 5A is a plan view illustrating the nozzle plate 3, FIG. 5B is a cross-sectional view taken along a line A2-A2 of FIG. 5A to illustrate the nozzle plate 3, and FIG. 5C is a rear view illustrating the nozzle plate 3.

As illustrated in FIGS. 5A to 5C, the nozzle plate 3 according to this modification has a configuration similar to that of the nozzle plate 3 of the first embodiment except that the cylindrical fitting portion 7 of the nozzle plate 3 in the first embodiment is omitted, only a part corresponding to the plate body portion 8 of the nozzle plate 3 of the first embodiment is provided, and the four reinforcing protrusions 30 are omitted. That is, the nozzle plate 3 according to this modification has a configuration similar to that of the nozzle plate 3 of the first embodiment, regarding the nozzle orifice 6, the swirl chamber 13, the first and second fuel guide grooves 18 and 20, the common fuel guide groove 21, the bottomed recess 16 (the cylindrical inner surface 26 as a spray guide), and the gate seat 27. In addition, similar to the nozzle plate 3 of first embodiment, the nozzle plate 3 according to this modification is fixed to the valve body 4 while the inner surface 10 of the plate body portion 8 abuts on the leading end surface 11 of the valve body 4. Using the nozzle plate 3 according to this modification, it is possible to obtain effects similar to those of the nozzle plate 3 of the first embodiment.

Figure 6:
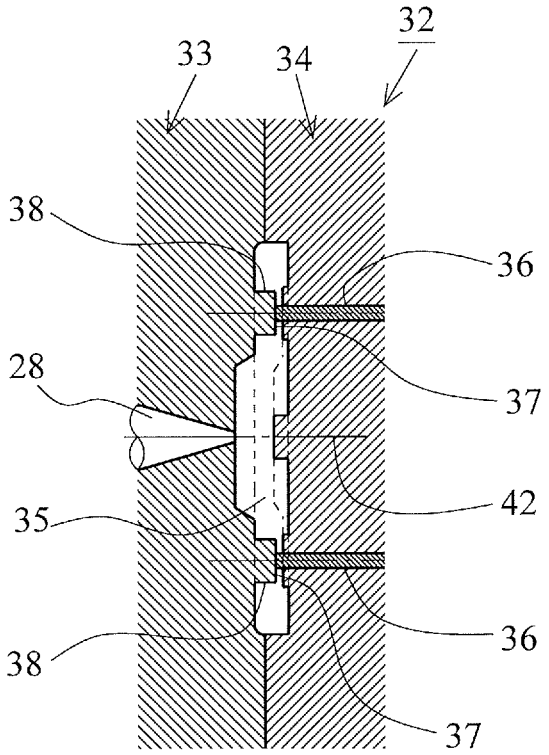
FIG. 6 is a cross-sectional view illustrating a mold for injection-molding the nozzle plate according to the first modification of the first embodiment of the invention.

FIG. 6 is a diagram illustrating a mold structure for injection-molding the nozzle plate 3 according to this modification. The mold 32 of FIG. 6 includes first and second molds 33 and 34, a cavity 35 formed between the first and second molds 33 and 34, and a nozzle orifice shaping pin 36 protruding into the cavity 35 to form the nozzle orifice 6. A tip of the nozzle orifice shaping pin 36 impinges on the cavity inner surface 37 of the first mold 33. The impinging part between the first mold 33 and the nozzle orifice shaping pin 36 is a convex portion 38 for shaping the bottomed recess 16. The cavity 35 does not have the second cavity portion 41 compared to the cavity 35 of the mold 32 of the first embodiment, and nearly matches the first cavity portion 40 of the cavity 35 of the mold 32 of the first embodiment. In addition, at the center of the cavity 35, a gate 28 for injecting molten resin into the cavity 35 is opened. The center of the opening of the gate 28 is positioned on the center axis 42 of the cavity 35 at equal distances from the centers of a plurality of nozzle orifices 6 (at the center of the nozzle orifice shaping pin 36) (refer to FIGS. 5A and 5B).

In this mold 32, as molten resin is injected from the gate 28 to the cavity 35, the molten resin flows radially inside the cavity 35 and reaches the parts for shaping a plurality of nozzle orifices 6 in the cavity 35 (the cavity portion that surrounds a plurality of nozzle orifice shaping pins 36) at the identical time. After the molten resin is filled in the cavity portion that surrounds a plurality of nozzle orifice shaping pins 36, the molten resin uniformly and radially flows to a radial outward end of the cavity 35. Then, the molten resin is filled in the entire cavity 35. In addition, in the mold 32 according to this embodiment, an injection pressure and a follow-up pressure are uniformly and reliably applied to a thin part where the nozzle orifice 6 is formed (the part between the bottom surface 17 of the bottomed recess 16 and the bottom surface 14 of the swirl chamber 13). Therefore, it is possible to shape the nozzle orifice 6 and its surrounding parts with high accuracy. In addition, by injection-molding the nozzle plate 3 using the mold 32 according to this embodiment, it is possible to improve manufacturing efficiency of the nozzle plate 3 and reduce cost of the nozzle plate 3, compared to a case where the nozzle plate 3 is fabricated by cutting or machining. Note that the nozzle plate 3 subjected to the injection molding has a separation trace (gate trace) 28*a* of the gate 28 at the center of the gate seat 27 (at equal distances from the centers of each nozzle orifice 6).

<Second Modification of Nozzle Plate>

Figure 7C:
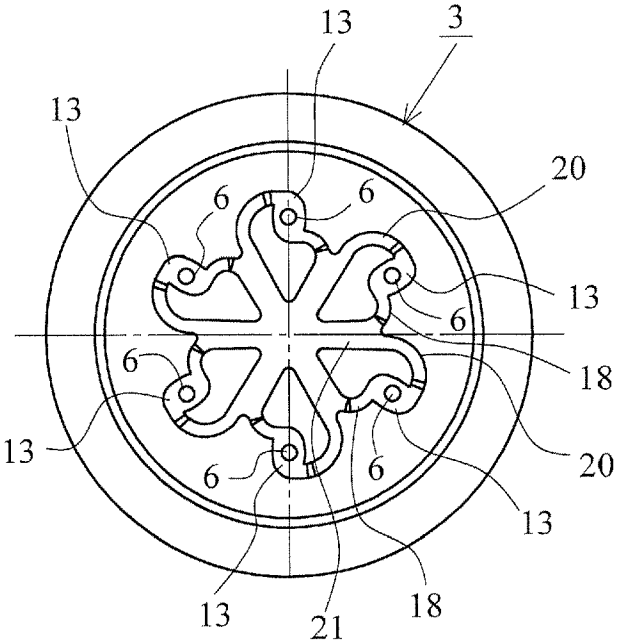
Figure 7B:
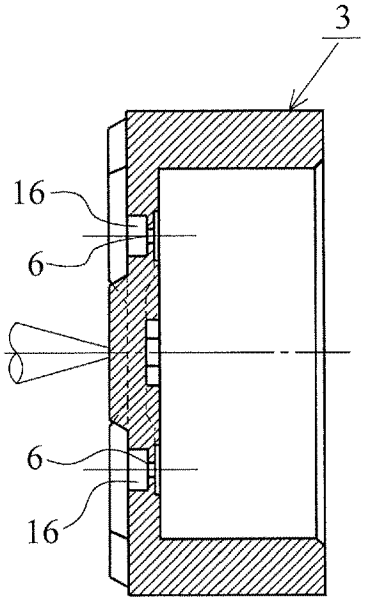
Figure 7A:
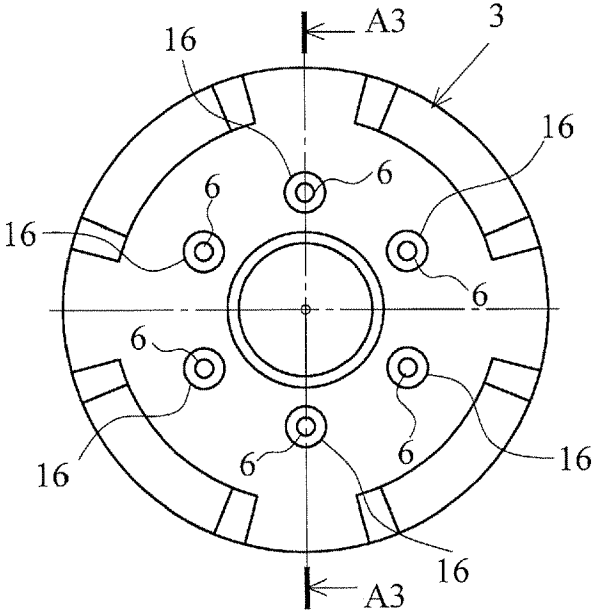

FIGS. 7A to 7C are diagrams illustrating a nozzle plate 3 according to a second modification of the first embodiment and correspond to FIGS. 2A to 2D. Note that FIG. 7A is a plan view illustrating the nozzle plate 3, FIG. 7B is a cross-sectional view taken along a line A3-A3 of FIG. 7A to illustrate the nozzle plate 3, and FIG. 7C is a rear view illustrating the nozzle plate 3.

As illustrated in FIGS. 7A to 7C, the nozzle plate 3 according to this modification has a configuration similar to that of the nozzle plate 3 of the first embodiment except that six nozzle orifices 6, six bottomed recesses 16 (cylindrical inner surfaces 26 as a spray guide), and six swirl chambers 13 are formed at equal intervals around the center of the plate body portion 8, and six common fuel guide grooves 21 are arranged between the neighboring nozzle orifices 6. Using this nozzle plate 3 according to this modification, it is possible to obtain the effects similar to those of the nozzle plate 3 of the first embodiment.

<Second Embodiment>

FIGS. 8A to 8D are diagrams illustrating a nozzle plate 3 according to a second embodiment. Note that FIG. 8A is a front view illustrating the nozzle plate 3, FIG. 8B is a cross-sectional view taken along a line A4-A4 of FIG. 8A to illustrate the nozzle plate 3, and FIG. 8C is a rear view illustrating the nozzle plate 3.

The nozzle plate 3 according to the second embodiment is similar to the nozzle plate 3 of the first embodiment in that the nozzle plate 3 is a bottomed cylindrical body provided with a cylindrical fitting portion 7 and a plate body portion 8 integrally formed in one end side of the cylindrical fitting portion 7 and formed of synthetic resin. However, in the nozzle plate 3 according to the second embodiment, the plate body portion 8 has a thickness larger than that of the plate body portion 8 of the nozzle plate 3 of the first embodiment, and the plate body portion 8 has a strength higher than that of the plate body portion 8 of the nozzle plate 3 of the first embodiment. Therefore, the strength reinforcing protrusion 30 and the gate seat 27 are omitted from the nozzle plate 3 of the first embodiment.

The plate body portion 8 is provided with four nozzle orifices 6 arranged at equal intervals on the identical circumference centered at the center axis 12 (center of the plate body portion 8). In addition, the outer surface 15 side of the plate body portion 8 is provided with a bottomed recess 16 coaxial with the center of the nozzle orifice 6. In this bottomed recess 16, an outer diameter of the bottom surface 17 is slightly larger than that of the nozzle orifice 6, and a tapered inner surface 46 (spray guide) is enlarged from the bottom surface 17 outward of the bottomed recess 16, so that the tapered inner surface 46 suppresses dispersion of the spray generated by injecting fuel from the nozzle orifice 6, and the injection direction of the spray is controlled by the tapered inner surface 46. As a result, fuel particles of the spray flowing from the bottomed recess 16 are less attached on inner wall surface of the intake pipe 2 or the like. Therefore, fuel use efficiency is improved.

In the inner surface 10 side of the plate body portion 8, swirl chambers 13 are formed in the identical positions as those of the nozzle orifices 6. The swirl chamber 13 is an oval recess as illustrated in FIG. 3A and is provided with the nozzle orifice 6 in its center. The nozzle orifice 6 is formed in a thin part between the bottom surface 14 of the swirl chamber 13 and the bottom surface 17 of the bottomed recess 16. One end side of the nozzle orifice 6 is opened to the bottom surface 14 of the swirl chamber 13, and the other end side of the nozzle orifice 6 is opened to the bottom surface 17 of the bottomed recess 16.

The swirl chamber 13 is connected to the fuel injection nozzle 5 of the valve body 4 through the first and second fuel guide grooves 18 and 20, and the fuel injected from the fuel injection nozzle 5 is guided through the first and second fuel guide grooves 18 and 20. The first and second fuel guide grooves 18 and 20 include a first fuel guide groove portion 47*a* formed to have the identical depth as that of the swirl chamber 13 and connected to the swirl chamber 13, and a second fuel guide groove portion 47*b* which is a sloped groove having a depth gradually increasing in proportion to a distance from a part connected to the first fuel guide groove portion 47*a*. The first fuel guide groove portion 47*a* includes a straight part opened to the swirl chamber 13 such that the swirl chamber side connecting portions 18*a* and 20*a* are perpendicular to the major axis 22 of the swirl chamber 13, and an arc-shaped curved part that connects the straight part and the second fuel guide groove portion 47*b*. The second fuel guide groove portion 47*b* is formed in the common fuel guide groove 48 that guides fuel to the neighboring swirl chamber 13. The common fuel guide groove 48 is formed between the neighboring nozzle orifices 6 to extend radially outward from the center of the plate body portion 8.

As illustrated in FIG. 8C, the inner surface 10 side of the plate body portion 8 has an axial symmetrical shape with respect to the center line 24 extending perpendicularly to the center axis 12 and in parallel to the X-axis. In addition, as illustrated in FIG. 8C, the inner surface 10 side of the plate body portion 8 has an axial symmetrical shape with respect to the center line 25 extending perpendicularly to the center axis 12 and in parallel to the Y-axis. Furthermore, since the length of the second fuel guide groove 20 (the length from the center of the plate body portion 8 to the swirl chamber 13) is different from the length of the first fuel guide groove 18 (the length from the center of the plate body portion 8 to the swirl chamber 13), the first and second fuel guide groove portions 47*a* and 47*b* are formed to have lengths different from those of the first and second fuel guide grooves 18 and 20, so that the fuel injected from the fuel injection nozzle 5 is guided through the second and first fuel guide grooves 20 and 18, and the identical amount of fuel reaches the swirl chamber 13. That is, if the second fuel guide groove 20 is longer than the first fuel guide groove 18, the length of the second fuel guide groove portion 47*b* of the second fuel guide groove 20 is set to be longer than the length of the second fuel guide groove portion 47*b* of the first fuel guide groove 18, so that the fuel can easily flow through the second fuel guide groove 20, and the identical amount of fuel can flow from the swirl chamber side connecting portions 18*a* and 20*a* of the first and second fuel guide grooves 18 and 20 to the swirl chamber 13.

Using the nozzle plate 3 according to the second embodiment described above, it is possible to obtain the effects similar to those of the nozzle plate 3 of the first embodiment.

<Modification of Second Embodiment>

Figures 9A, 9B, 9C:
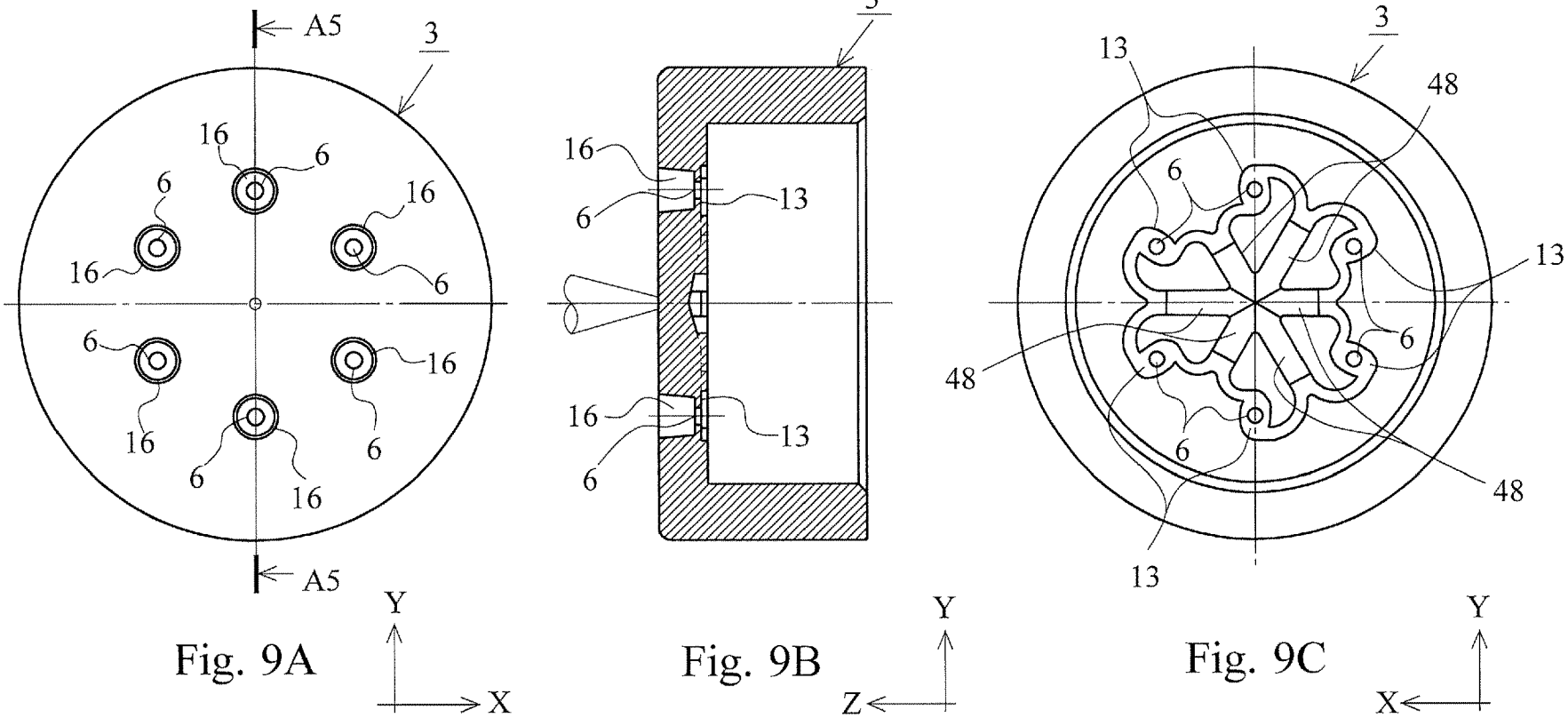

FIGS. 9A to 9C are diagrams illustrating a modification of the nozzle plate 3 of the second embodiment. Note that FIG. 9A is a front view illustrating the nozzle plate 3, FIG. 9B is a cross-sectional view taken along a line A5-A5 of FIG. 9A to illustrate the nozzle plate 3, and FIG. 9C is a rear view illustrating the nozzle plate 3.

As illustrated in FIGS. 9A to 9C, the nozzle plate 3 according to this modification has a configuration similar to that of the nozzle plate 3 of the second embodiment except that six nozzle orifices 6, six bottomed recesses 16 (the tapered inner surface 46 as a spray guide), and six swirl chambers 13 are formed at equal intervals around the center of the plate body portion 8, and six common fuel guide grooves 48 are formed between the neighboring nozzle orifices 6. Using the nozzle plate 3 according to this modification, it is possible to obtain the effects similar to those of the nozzle plate 3 of the second embodiment.

<Third Embodiment>

Figures 10A, 10B, 10C, 10D:
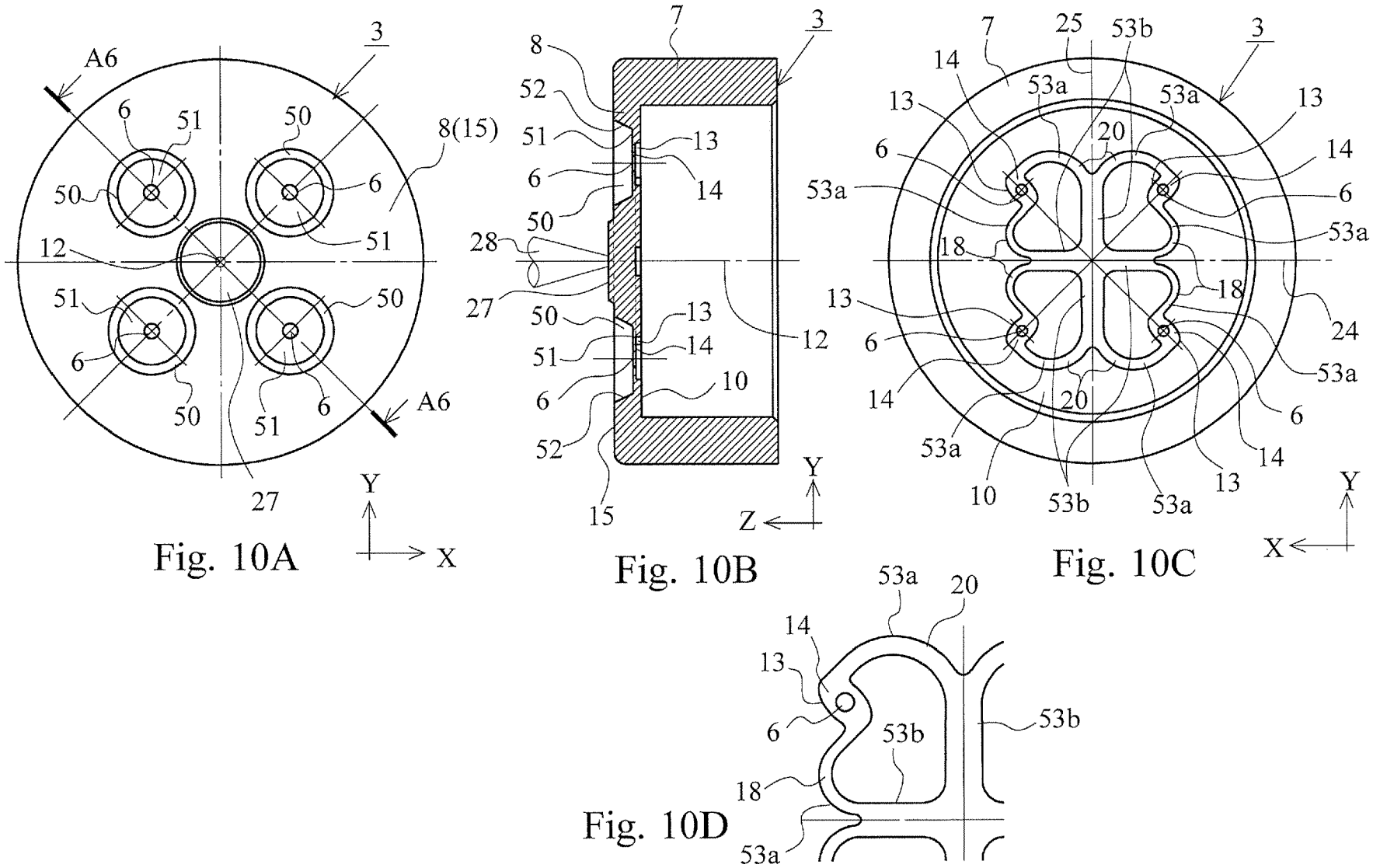

FIGS. 10A to 10D are diagrams illustrating a nozzle plate 3 according to a third embodiment. Note that FIG. 10A is a front view illustrating the nozzle plate 3, FIG. 10B is a cross-sectional view taken along a line A6-A6 of FIG. 10A to illustrate the nozzle plate 3, FIG. 10C is a rear view illustrating the nozzle plate 3, and FIG. 10D is a partial enlarged view of FIG. 10C.

The nozzle plate 3 according to the third embodiment is similar to the nozzle plate 3 of the first embodiment in that the nozzle plate 3 is a bottomed cylindrical body provided with a cylindrical fitting portion 7 and a plate body portion 8 integrally formed in one end side of the cylindrical fitting portion 7 and formed of synthetic resin.

The plate body portion 8 is provided with four nozzle orifices 6 arranged at equal intervals on the identical circumference centered at the center axis 12 (center of the plate body portion 8). In addition, the outer surface 15 side of the plate body portion 8 is provided with a bottomed recess 50 coaxial with the center of the nozzle orifice 6. In this bottomed recess 50, an outer diameter of the bottom surface 51 is larger than that of the nozzle orifice 6, and a tapered inner surface 52 is enlarged from the bottom surface 51 outward of the bottomed recess 50, such that the spray generated by injecting fuel from the nozzle orifice 6 does not collide with the tapered inner surface 52. In addition, a gate seat 27 having a truncated conical shape is protrudingly formed in the center of the plate body portion 8, and the gate 28 is placed in the center of the gate seat 27.

In the inner surface 10 side of the plate body portion 8, the swirl chambers 13 are formed in the identical positions as the nozzle orifices 6. The swirl chamber 13 is an oval recess as illustrated in FIG. 3A and is provided with the nozzle orifice 6 in its center. The nozzle orifice 6 is formed in a thin part between the bottom surface 14 of the swirl chamber 13 and the bottom surface 51 of the bottomed recess 50. One end side of the nozzle orifice 6 is opened to the bottom surface 14 of the swirl chamber 13, and the other end side of the nozzle orifice 6 is opened to the bottom surface 51 of the bottomed recess 50.

The swirl chamber 13 is connected to the fuel injection nozzle 5 of the valve body 4 through the first and second fuel guide grooves 18 and 20, and the fuel injected from the fuel injection nozzle 5 is guided through the first and second fuel guide grooves 18 and 20. The first and second fuel guide grooves 18 and 20 include a first fuel guide groove portion 53*a* formed to have the identical depth as that of the swirl chamber 13 and connected to the swirl chamber 13, and a second fuel guide groove portion 53*b* that guides the fuel to the first fuel guide groove portion 53*a*. The first fuel guide groove portion 53*a* includes a straight part (swirl chamber side connecting portions 18*a* and 20*a*) opened to the swirl chamber 13 perpendicularly to the major axis 22 of the swirl chamber 13 and an arc-shaped curved part that connects the straight part and the second fuel guide groove portion 53*b*. The second fuel guide groove portion 53*b* is a common fuel guide groove where a pair of first fuel guide groove portions 53*a* connected to the neighboring swirl chambers 13 are branched. In addition, the second fuel guide groove portion 53*b* is formed between the neighboring nozzle orifices 6 to extend radially outward from the center of the plate body portion 8.

As illustrated in FIG. 10C, the inner surface 10 side of the plate body portion 8 has an axial symmetrical shape with respect to the center line 24 extending perpendicularly to the center axis 12 and in parallel to the X-axis. In addition, as illustrated in FIG. 10C, the inner surface 10 side of the plate body portion 8 has an axial symmetrical shape with respect to the center line 25 extending perpendicularly to the center axis 12 and in parallel to the Y-axis. Since the length of one of the first and second fuel guide grooves 18 and 20 (the length from the center of the plate body portion 8 to the swirl chamber 13) is different from the length of the other one of the first and second fuel guide grooves 18 and 20 (the length from the center of the plate body portion 8 to the swirl chamber 13), the first fuel guide groove portion 53*a* is formed such that widths are different between the first and second fuel guide grooves 18 and 20. Therefore, the fuel injected from the fuel injection nozzle 5 is guided through the first and second fuel guide grooves 18 and 20 and reaches the swirl chamber 13, and the identical amount of fuel flows from the swirl chamber side connecting portions 18*a* and 20*a* of the first and second fuel guide grooves 18 and 20 to the swirl chamber. That is, if the second fuel guide groove 20 is longer than the first fuel guide groove 18, the width of the first fuel guide groove portion 53*a* of the second fuel guide groove 20 is set to be larger than the width of the first fuel guide groove portion 53*a* of the first fuel guide groove 18, so that the fuel can easily flow through the second fuel guide groove 20, and the identical amount of fuel can flow from the swirl chamber side connecting portions 18*a* and 20*a* of the first and second fuel guide grooves 18 and 20 to the swirl chamber 13.

Using the nozzle plate 3 according to the third embodiment described above, it is possible to obtain the effects similar to those of the nozzle plate 3 of the first embodiment.

<Fourth Embodiment>

Figures 11A, 11B, 11C:
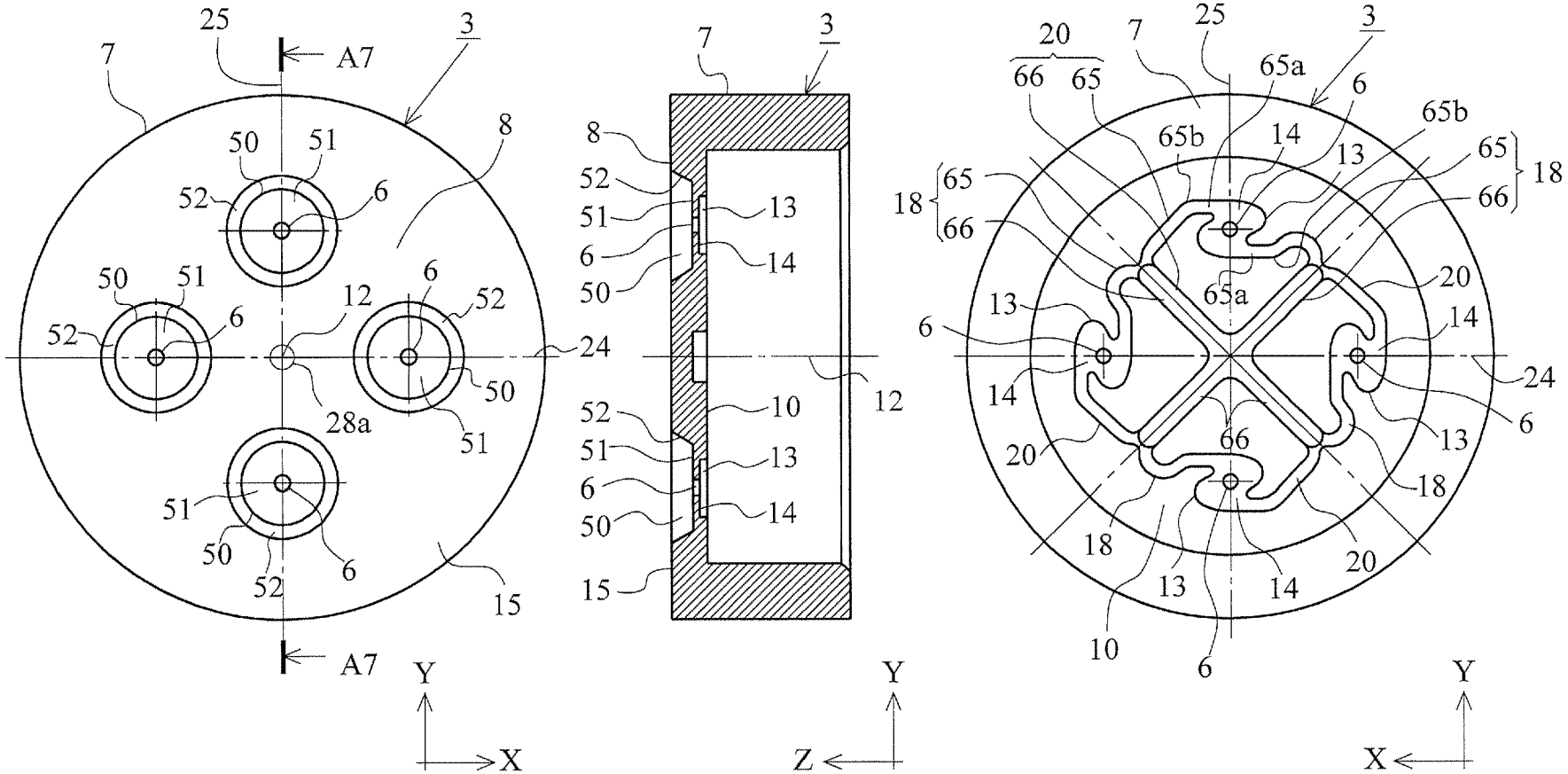

FIGS. 11A to 11C are diagrams illustrating a nozzle plate 3 according to a fourth embodiment. Note that FIG. 11A is a front view illustrating the nozzle plate 3, FIG. 11B is a cross-sectional view taken along a line A7-A7 of FIG. 11A to illustrate the nozzle plate 3, FIG. 11C is a rear view illustrating the nozzle plate 3, and FIG. 11D is a partial enlarged view of FIG. 11C.

The nozzle plate 3 according to the fourth embodiment is similar to the nozzle plate 3 of the first embodiment in that the nozzle plate 3 is a bottomed cylindrical body provided with a cylindrical fitting portion 7 and a plate body portion 8 integrally formed in one end side of the cylindrical fitting portion 7 and formed of synthetic resin.

The plate body portion 8 is provided with four nozzle orifices 6 arranged at equal intervals on the identical circumference centered at the center axis 12 (center of the plate body portion 8) and having a circular shape as seen in a plan view. In addition, the outer surface 15 side of the plate body portion 8 is provided with a bottomed recess 50 coaxial with the center of the nozzle orifice 6. In this bottomed recess 50, an outer diameter of the bottom surface 51 is larger than that of the nozzle orifice 6, and a tapered inner surface 52 is enlarged from the bottom surface 51 outward of the bottomed recess 50, such that the spray generated by injecting fuel from the nozzle orifice 6 does not collide with the tapered inner surface 52. In addition, a separation trace 28*a* of the gate is formed in the center of the plate body portion 8.

Figure 12:
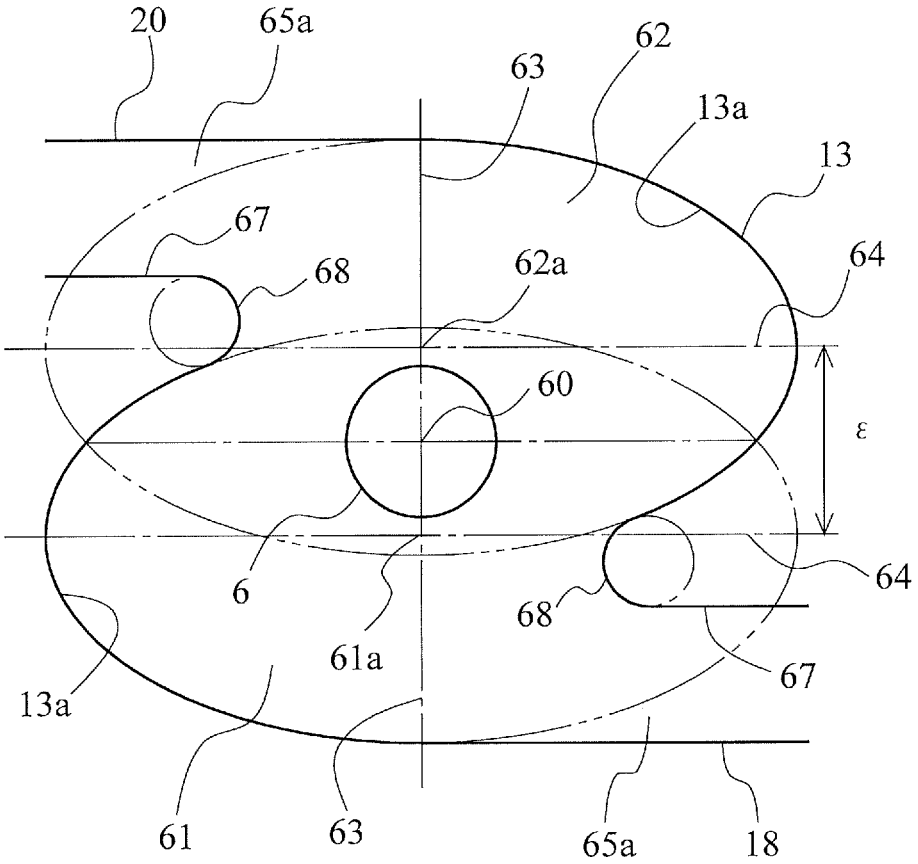
FIG. 12 is a partial enlarged view illustrating the nozzle plate of FIG. 11C.

In the inner surface 10 side of the plate body portion 8 (a surface side facing the fuel injection nozzle), the swirl chambers 13 are formed in the identical positions as the nozzle orifices 6. The swirl chamber 13 has a nozzle orifice 6 in its center 60 (refer to FIG. 12). The nozzle orifice 6 is formed in a thin part between the bottom surface 14 of the swirl chamber 13 and the bottom surface 51 of the bottomed recess 50. One end side of the nozzle orifice 6 is opened to the bottom surface 14 of the swirl chamber 13, and the other end side of the nozzle orifice 6 is opened to the bottom surface 51 of the bottomed recess 50. This nozzle orifice 6 is connected to the fuel injection nozzle of the valve body through the swirl chamber 13 and the first and second fuel guide grooves 18 and 20 opened to the swirl chamber 13.

As illustrated in FIGS. 11A to 11C and 12, the swirl chamber 13 is shaped by combining a first oval recess 61 formed in the inner surface 10 side of the plate body portion 8 (a surface side facing the fuel injection nozzle) and a second oval recess 62 having the identical size as that of the first oval recess 61. In addition, minor axes 63 of the first and second oval recesses 61 and 62 are placed on a center line 24 in parallel to the X-axis through the center of the plate body portion 8 or on a center line 25 in parallel to the Y-axis through the center of the plate body portion 8. That is, the second oval recess 62 has a minor axis 63 arranged on an extension line of the minor axis 63 of the first oval recess 61 (on the center line 24 or 25) and a center 62*a* (cross point between the minor axis 63 and the major axis 64) arranged at a predetermined interval ε from the center 61*a* of the first oval recess 61 (cross point between the minor axis 63 and the major axis 64). In addition, in this swirl chamber 13, the first and second oval recesses 61 and 62 partially overlap with each other. Furthermore, a first fuel guide groove 18 is opened in the end side of the minor axis 63 of the first oval recess 61 that does not overlap with the second oval recess 62 and is in the end side of the minor axis 63 of the first oval recess 61, and a second fuel guide groove 20 is opened in the end side of the minor axis 63 of the second oval recess 62 that does not overlap with the first oval recess 61 and is in the end side of the minor axis 63 of the second oval recess 62.

The first and second fuel guide grooves 18 and 20 have a first fuel guide groove portion 65 connected to the swirl chamber 13 and a second fuel guide groove portion 66 that guides the fuel injected from the fuel injection nozzle to the first fuel guide groove portion 65. The first fuel guide groove portion 65 of the first fuel guide groove 18 and the first fuel guide groove portion 65 of the second fuel guide groove 20 are formed to have the identical depth as that of the swirl chamber 13, equal widths, and equal flow channel lengths from the second fuel guide groove portion 66 to the swirl chamber 13. The first fuel guide groove portion 65 connected to the other swirl chamber 13 neighboring to the first fuel guide groove portion 65 connected to one of the neighboring swirl chambers 13 is branched from the end of the common second fuel guide groove portion 66. Four second fuel guide groove portions 66 are provided radially from the center of the inner surface 10 side of the plate body portion 8 at equal intervals. In addition, the four second fuel guide groove portions 66 have the identical shape. That is, the four second fuel guide groove portions 66 are formed to have equal flow channel lengths from the center of the inner surface 10 side of the plate body portion 8 to the first fuel guide groove portion 65, equal widths, and equal depths. Furthermore, a swirl chamber side connecting portion 65*a* (straight part) of the first fuel guide groove 18 and a swirl chamber side connecting portion 65*a* (straight part) of the second fuel guide groove 20 are formed to be double-symmetrical with respect to the center 60 of the swirl chamber 13. Moreover, the first fuel guide groove portion 65 has a swirl chamber side connecting portion 65*a* (straight part) opened to the swirl chamber 13 perpendicularly to the minor axis 63 of the swirl chamber 13, and a curved flow channel portion 65*b* that makes a centrifugal force act on the fuel flowing to the swirl chamber 13 outward of the center 60 of the swirl chamber 13. Here, the curved flow channel portion 65*b* of the first fuel guide groove 18 connected to a radial inner end side of the swirl chamber 13 is curved to protrude radially inward. Meanwhile, the curved flow channel portion 65*b* of the second fuel guide groove 20 connected to a radial outer end side of the swirl chamber 13 is curved to protrude radially outward. As a result, the fuel flowing from the first and second fuel guide grooves 18 and 20 to the swirl chamber 13 sufficiently revolves depending on the shape of the inner wall surface 13*a* of the swirl chamber 13, and the amount of fuel flowing from the nozzle orifice 6 without a sufficient rotary motion is reduced. In addition, using the first and second fuel guide grooves 18 and 20, the identical amount of the fuel injected from the fuel injection nozzle can flow to the swirl chamber 13.

A side wall surface 67 positioned close to the second oval recess 62 of the swirl chamber side connecting portion 65*a* of the first fuel guide groove 18 is connected to the inner wall surface 13*a* of the second oval recess 62 to form a smooth curved surface 68 such that the space around the nozzle orifice 6 in the swirl chamber 13 is narrowed in a part connected to the inner wall surface 13*a* of the second oval recess 64. In addition, a side wall surface 67 positioned close to the first oval recess 61 of the swirl chamber side connecting portion 65*a* of the second fuel guide groove 20 is connected to the inner wall surface 13*a* of the first oval recess 61 to form a smooth curved surface 68 such that the space around the nozzle orifice 6 in the swirl chamber 13 is narrowed in a part connected to the inner wall surface 13*a* of the first oval recess 61. As a result, a flow of the fuel making a rotary motion inside the first oval recess 61 and a flow of the fuel making a rotary motion inside the second oval recess 62 react with each other, so that a fuel revolving velocity inside the swirl chamber 13 increases.

In the nozzle plate 3 according to the fourth embodiment described above, the identical amount of fuel flowing from the swirl chamber side connecting portions 65*a* of the first and second fuel guide grooves 18 and 20 to the swirl chamber 13 sufficiently revolves inside the swirl chamber 13 in the identical direction and is guided to the nozzle orifice 6 at the identical time. Therefore, it is possible to suppress a variation of the spray generated by injecting fuel from the nozzle orifice 6 (a variation in fuel particle size and a variation in concentration of the fuel particle in the spray) and achieve uniform atomized spray.

In the nozzle plate 3 according to the fourth embodiment, the fuel flowing from the swirl chamber side connecting portion 65*a* of the first fuel guide groove 18 and revolving inside the swirl chamber 13 and the fuel flowing from the swirl chamber side connecting portion 65*a* of the second fuel guide groove 20 and revolving inside the swirl chamber 13 react with each other to increase the fuel rotary force. As a result, using the nozzle plate 3 according to the fourth embodiment, it is possible to promote atomization of the fuel particles in the spray generated by injecting fuel from the nozzle orifice 6.

<First Modification of Fourth Embodiment>

Figure 13A:
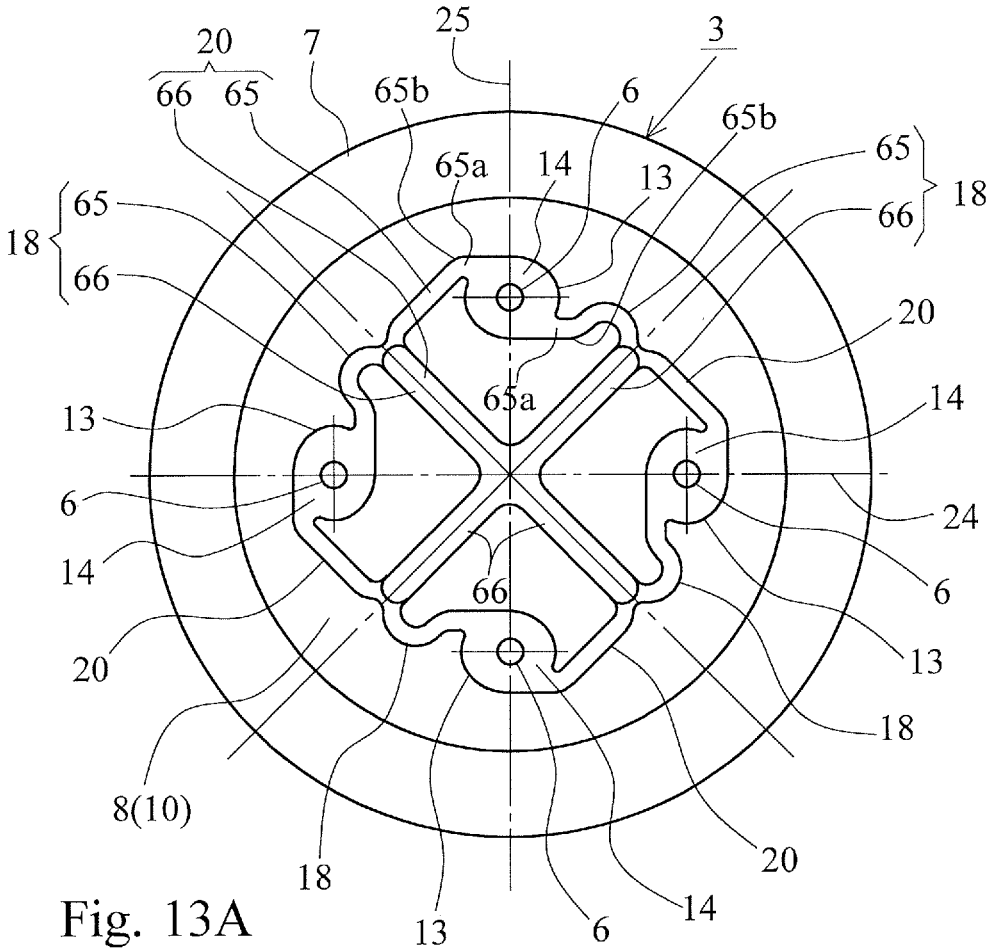
Figure 13B:
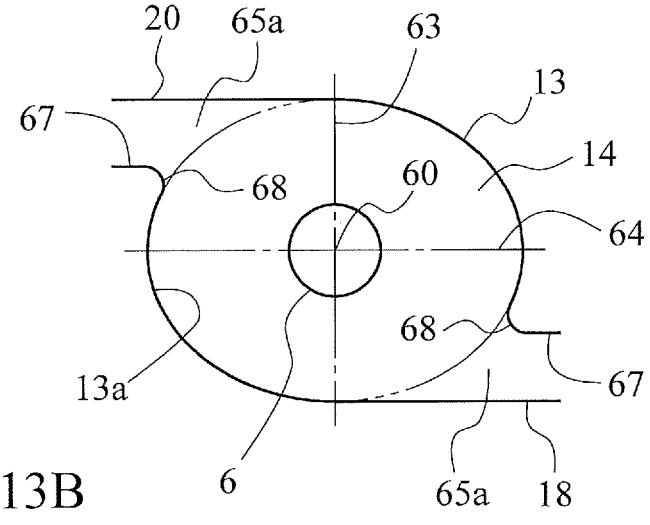

FIGS. 13A and 13B are diagrams illustrating a nozzle plate 3 according to a first modification of the fourth embodiment of the invention. Note that FIG. 13A is a rear view illustrating the nozzle plate 3, and FIG. 13B is a partial enlarged view of FIG. 13A.

The nozzle plate 3 according to this modification has a configuration similar to that of the nozzle plate 3 of the fourth embodiment except that the swirl chamber 13 is shaped in a single oval recess. That is, according to this modification, the minor axis 63 of the swirl chamber 13 is placed on a center line 24 in parallel to the X-axis through the center of the plate body portion 8 or on the center line 25 in parallel to the Y-axis through the center of the plate body portion 8. In addition, in the swirl chamber 13, the first fuel guide groove 18 is connected to one end side of the minor axis 63, and the second fuel guide groove 20 is connected to the other end side of the minor axis 63. Using the nozzle plate 3 according to this modification, it is possible to obtain the effects similar to those of the nozzle plate 3 of the fourth embodiment.

<Second Modification of Fourth Embodiment>

Figure 14A:
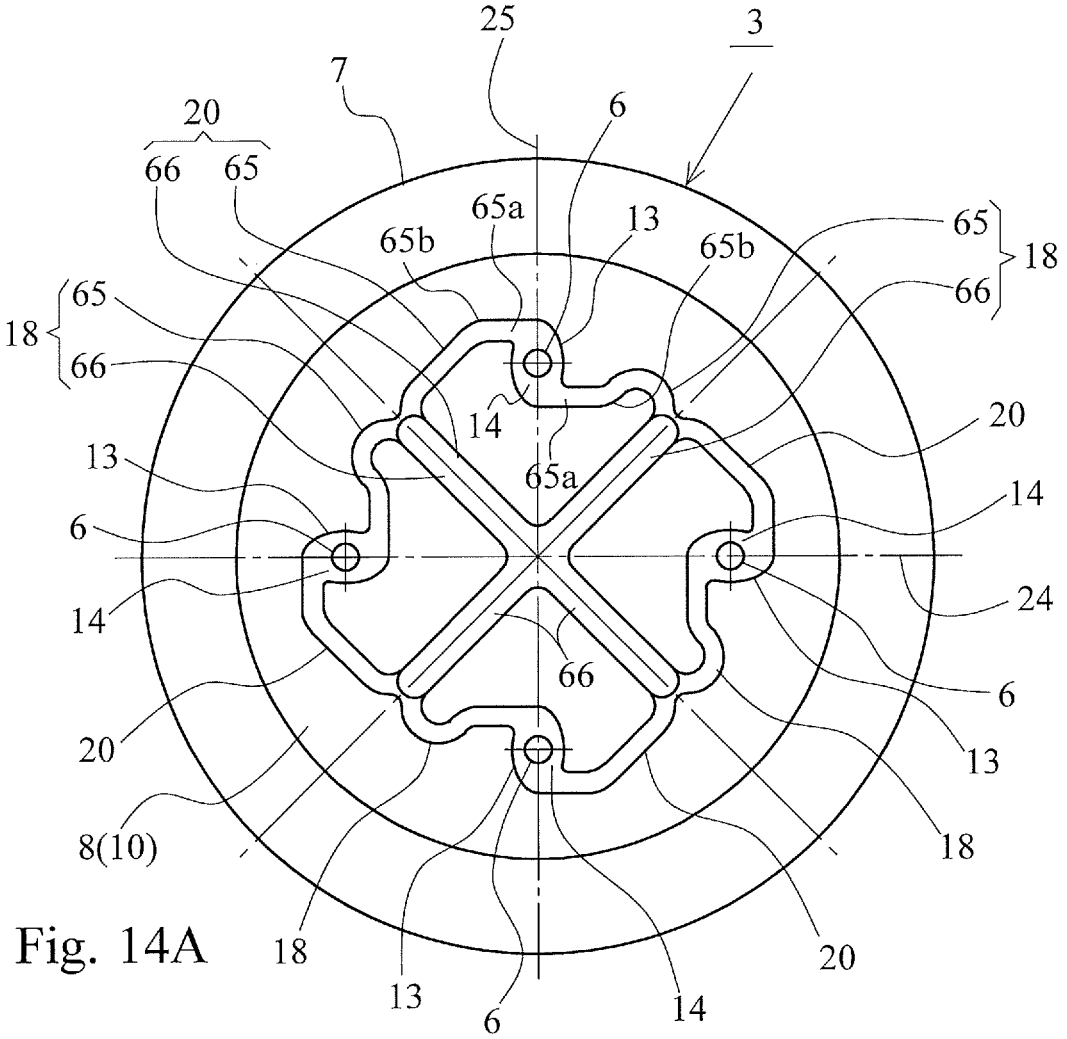
Figure 14B:
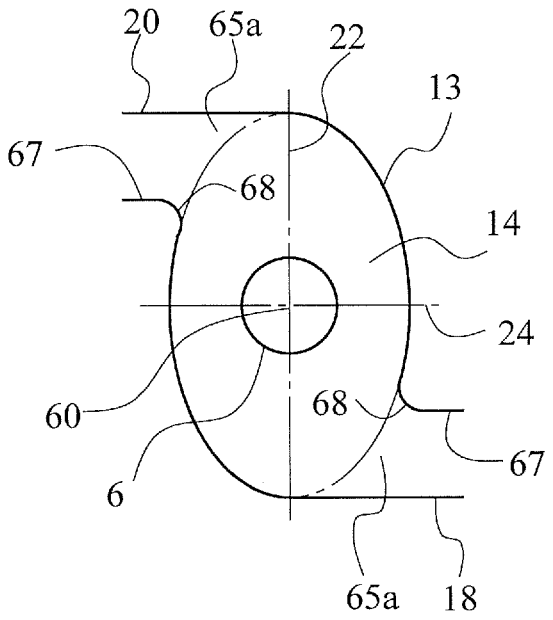
Figure 15A:
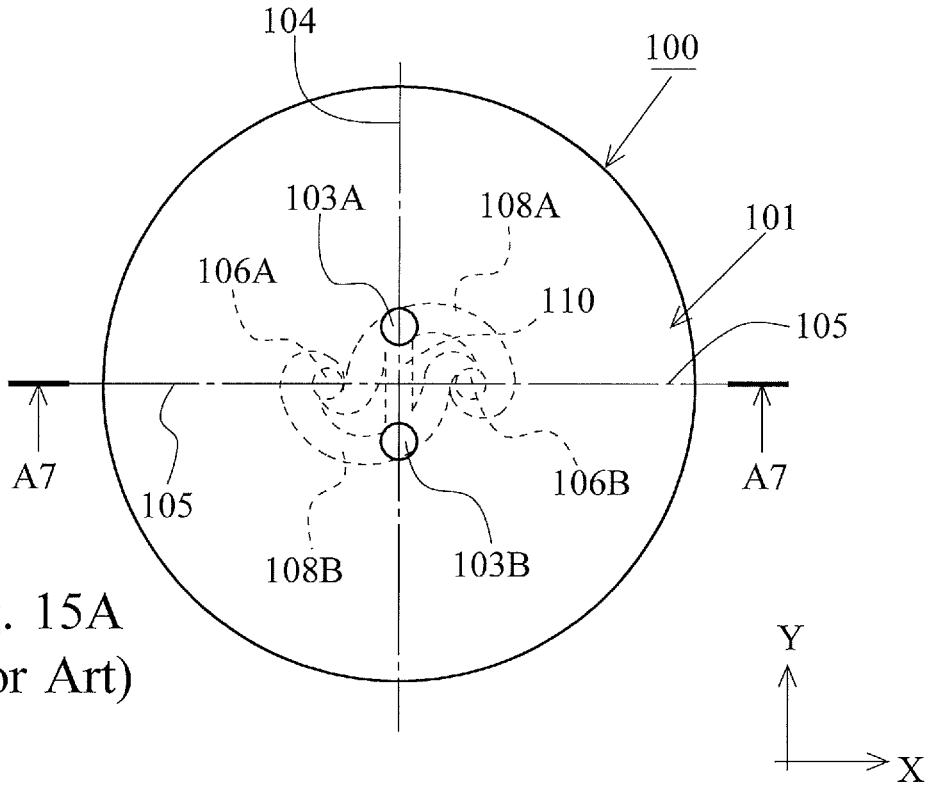
Fig. 15A (Prior Art)
Figure 15B:
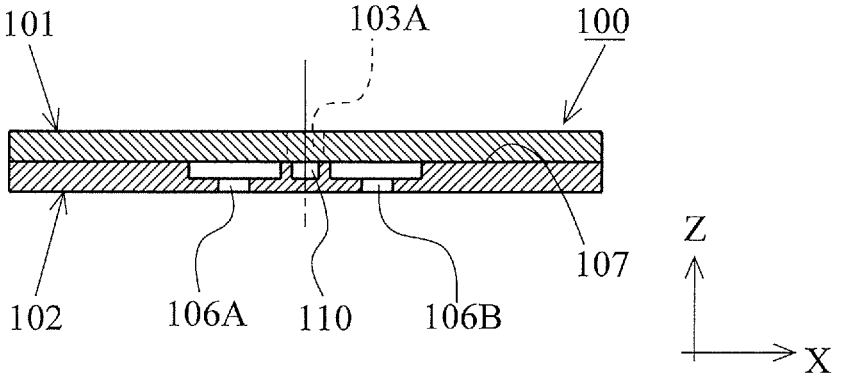
Fig. 15B (Prior Art)
Figure 16A:
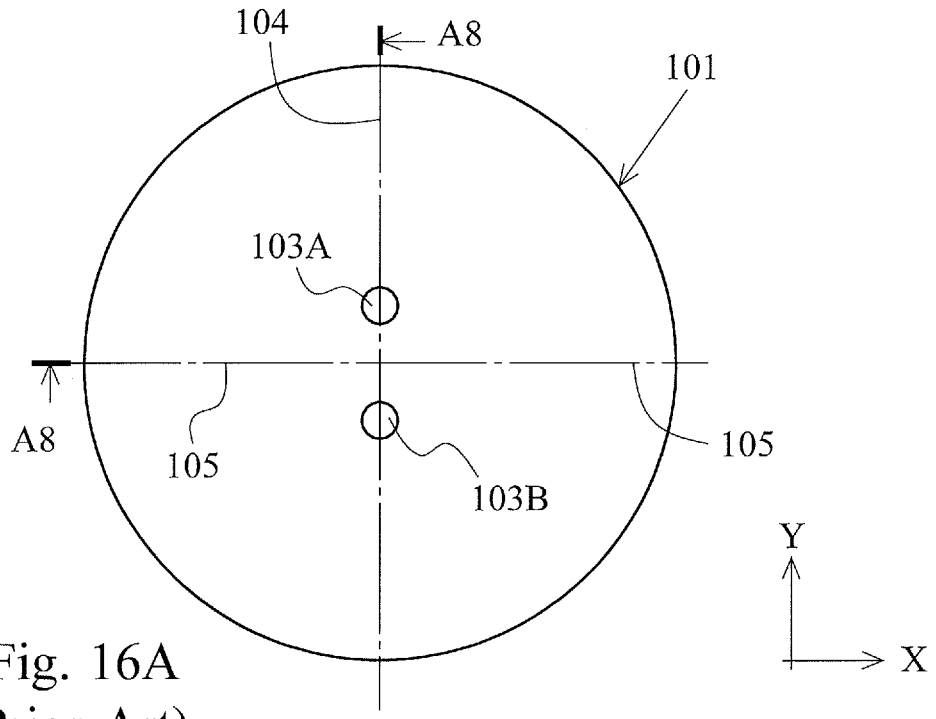
Fig. 16A (Prior Art)
Figure 16B:
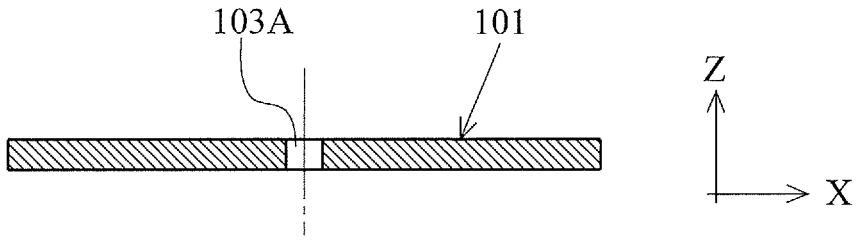
Fig. 16B (Prior Art)
Figure 17A:
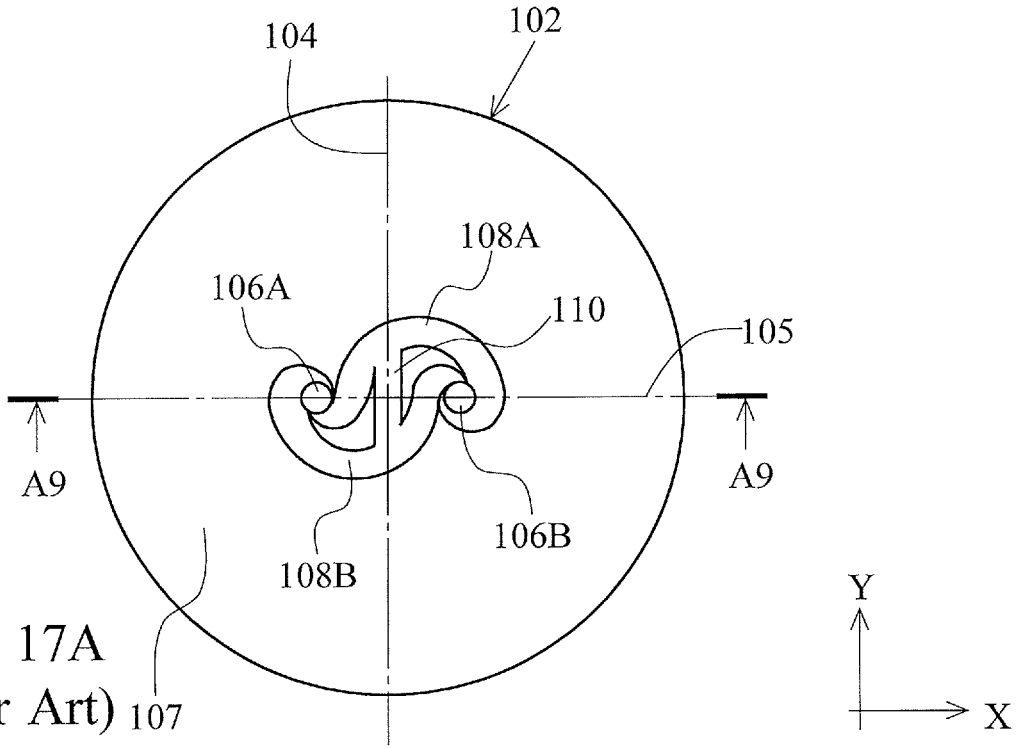
Fig. 17A (Prior Art)
Figure 17B:
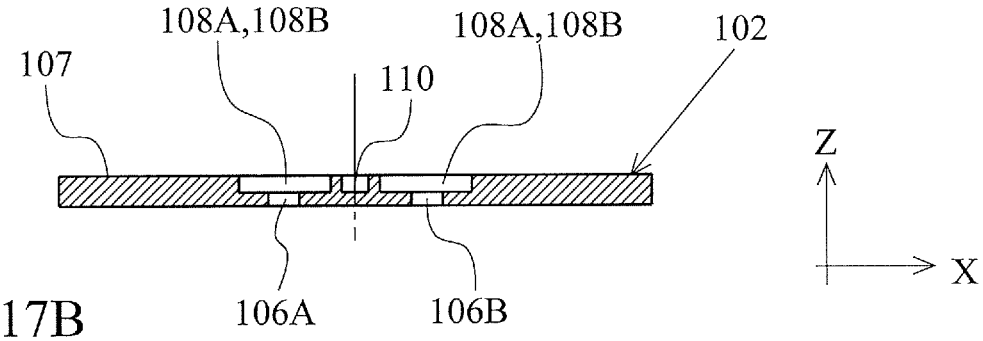
Fig. 17B (Prior Art)

FIGS. 14A and 14B are diagrams illustrating a nozzle plate 3 according to a second modification of the fourth embodiment of the invention. Note that FIG. 14A is a rear view illustrating the nozzle plate 3, and FIG. 14B is a partial enlarged view of FIG. 14A.

The nozzle plate 3 according to this modification has a configuration similar to that of the fourth embodiment except that the swirl chamber 13 is substituted with the swirl chamber 13 of the nozzle plate 3 of the first embodiment. That is, according to this modification, the major axis 22 of the swirl chamber 13 is placed on the center line 24 in parallel to the X-axis through the center of the plate body portion 8 or on the center line 25 in parallel to the Y-axis through the center of the plate body portion 8. In addition, in the swirl chamber 13, the first fuel guide groove 18 is connected to one end side of the major axis 22, and the second fuel guide groove 20 is connected to the other end side of the major axis 22. Using the nozzle plate 3 according to this modification, it is possible to obtain the effects similar to those of the nozzle plate 3 of the fourth embodiment.

<Other Embodiments>

In the nozzle plates 3 according to the first to third embodiments and their modifications, the shape of the swirl chamber 13 is not limited to the shape of FIG. 3A. The swirl chamber 13 of FIG. 3A may be substituted with the swirl chamber 13 of FIG. 3B or 3C.

In the nozzle plates 3 according to the aforementioned embodiments and their modifications, four or six nozzle orifices 6 are formed at equal intervals around the center of the plate body portion 8. However, without limiting thereto, a plurality of nozzle orifices 6 such as two or more nozzle orifices 6 may also be formed at equal intervals around the center of the plate body portion 8.

In the nozzle plate 3 according to the aforementioned embodiments and their modifications, a plurality of nozzle orifices 6 may also be formed at unequal intervals around the center of the plate body portion 8.

In the nozzle plate 3 according to the aforementioned embodiments and their modifications, the shape of the inner surface 10 side may be substituted with the shape of the inner surface 10 side of any one of the aforementioned embodiments and their modifications.

In the nozzle plate 3 according to the aforementioned embodiments and their modifications, the bottomed recess 16 of FIGS. 2A to 2D, the bottomed recess 16 of FIGS. 8A to 8D, and the bottomed recess 50 of FIGS. 10A to 10D and 11A to 11C may be appropriately selected depending on a required spray characteristic.

In the nozzle plate 3 according to the aforementioned embodiments and their modifications, the shaping is performed through injection molding. However, without limiting thereto, shaping may also be performed using any method such as a metal cutting/machining process or a metal injection molding process.

REFERENCE SIGNS AND NUMERALS

1 fuel injection unit,
3 nozzle plate (nozzle plate for fuel injection unit),
5 fuel injection nozzle,
6 nozzle orifice,
13 swirl chamber,
18, 20 fuel guide groove,
18*a*, 20*a* swirl chamber side connecting portion,
22 major axis,
43 first semi-oval recess,
44 second semi-oval recess,
60 center,
61 first oval recess,
61*a* center,
62 second oval recess,
62*a* center,
63 minor axis,
65*a* swirl chamber side connecting portion

The invention claimed is:

1. A nozzle plate for a fuel injection unit, comprising:

a plurality of nozzle orifices configured to face a fuel injection nozzle of the fuel injection unit to allow passage of fuel injected from the fuel injection nozzle through the nozzle plate, wherein each of the nozzle orifices is to communicate with the fuel injection nozzle through a respective swirl chamber, a respective first fuel guide groove, and a respective second fuel guide groove opened to the swirl chamber, wherein the swirl chamber of each of the nozzle orifices is shaped by bisecting the swirl chamber into a first semi-oval-shaped recess and a second semi-oval-shaped recess offset from each other along a major axis of the swirl chamber to form a surface side of the nozzle plate for facing the fuel injection nozzle as seen in a plan view, the first fuel guide groove opening to an offset portion of the second semi-oval-shaped recess and a first-end side of the first semi-oval-shaped recess with respect to the major axis, and the second fuel guide groove opening to an offset portion of the first semi-oval recess and a second-end side of the second semi-oval recess with respect to the major axis, wherein the first fuel guide groove and the second fuel guide groove of each of the nozzle orifices are formed such that an identical amount of fuel flows from the fuel injection nozzle to the respective swirl chamber through each of the first fuel guide groove and the second fuel guide groove, wherein a swirl chamber side connecting portion of the first fuel guide groove and a swirl chamber side connecting portion of the second fuel guide groove are formed to be symmetrical with respect to a center of the swirl chamber with respect to an X-axis and a Y-axis extending through a center of the respective nozzle orifice, and wherein each of the nozzle orifices is configured such that the identical amount of the fuel flowing from the fuel injection nozzle through the first fuel guide groove and the second fuel guide groove to the swirl chamber is guided to the respective nozzle orifice while revolving inside the swirl chamber in an identical direction.

2. The nozzle plate for the fuel injection unit according to claim 1, wherein each of the first fuel guide groove and the second fuel guide groove of each of the nozzle orifices has a first fuel guide groove portion with a depth identical to a depth of the swirl chamber and connected to the swirl chamber, and has a second fuel guide groove portion with a depth greater than a depth of the first fuel guide groove portion for guiding the fuel toward the first fuel guide groove portion, and the first fuel guide groove portion and the second fuel guide groove portion of the first fuel guide groove have a length different from a length of the first fuel guide groove portion and the second fuel guide groove portion of the second fuel guide groove.

3. The nozzle plate for the fuel injection unit according to claim 1, wherein each of the first fuel guide groove and the second fuel guide groove of each of the nozzle orifices has a first fuel guide groove portion with a depth identical to a depth of the swirl chamber and connected to the swirl chamber, and has a sloped second fuel guide groove portion having a depth gradually increasing in proportion to a distance from a part connected to the first fuel guide groove portion, and wherein the first fuel guide groove portion and the second fuel guide groove portion of the first fuel guide groove have lengths different from the first fuel guide groove portion and the second fuel guide groove portion of the second fuel guide groove.

4. The nozzle plate for the fuel injection unit according to claim 1, wherein each of the first fuel guide groove and the second fuel guide groove of each of the nozzle orifices has a first fuel guide groove portion connected to the swirl chamber and a second fuel guide groove portion configured to guide fuel toward the first fuel guide groove portion, and wherein the first fuel guide groove portion of the first fuel guide groove has a width different from the first fuel guide groove portion of the second fuel guide groove.

5. The nozzle plate for the fuel injection unit according to claim 1, wherein a discharge side of each of the nozzle orifices has a spray guide for suppressing dispersion of spray injected from the respective nozzle orifice.

6. The nozzle plate for the fuel injection unit according to claim 5, wherein an inner surface of the nozzle plate faces the fuel injection nozzle, the spray guide is a tapered inner surface of a recess formed in an outer surface opposite to the inner surface, each of the nozzle orifices is opened to a center of a bottom surface of the recess in the outer surface, and the tapered inner surface is enlarged from the bottom surface of the recess in the outer surface outward of the recess.

7. The nozzle plate for the fuel injection unit according to claim 1, wherein the first fuel guide groove and the second fuel guide groove of each of the nozzle orifices has a curved flow channel portion configured such that a centrifugal force outward from the center of the swirl chamber is exerted upon the fuel flowing to the swirl chamber.

* * * * *